US010486329B2

(12) United States Patent
Tran Hoai

(10) Patent No.: US 10,486,329 B2
(45) Date of Patent: Nov. 26, 2019

(54) METHODS AND SYSTEMS FOR IMPREGNATING WOOD WITH A POLYMER SOLUTION AND PRODUCTS THEREOF

(71) Applicant: CHON Technologies and Investments PTE. Limited, Singapore (SG)

(72) Inventor: Nam Tran Hoai, Bac Ninh (VN)

(73) Assignee: CHON INVESTMENT HOLDINGS LIMITED (VG)

( * ) Notice: Subject to any disclaimer, the term of this patent is extended or adjusted under 35 U.S.C. 154(b) by 128 days.

(21) Appl. No.: 15/411,796

(22) Filed: Jan. 20, 2017

(65) Prior Publication Data

US 2018/0207834 A1 Jul. 26, 2018

(51) Int. Cl.
*B27K 3/08* (2006.01)
*B27K 3/02* (2006.01)
(Continued)

(52) U.S. Cl.
CPC ..... *B27K 3/08* (2013.01); *B27K 3/0214* (2013.01); *B27K 3/0278* (2013.01); *B27K 3/10* (2013.01); *B27K 3/343* (2013.01); *B27K 2200/10* (2013.01)

(58) Field of Classification Search
CPC ..... B27K 3/08; B27K 3/0278; B27K 3/0214; B27K 3/10; B27K 3/343; B27K 2200/10
See application file for complete search history.

(56) References Cited

U.S. PATENT DOCUMENTS 3,964,863 A * 6/1976 Carr ..... B27K 3/08 427/440
3,968,276 A * 7/1976 Allen ..... B27K 3/0221 427/297
(Continued)

FOREIGN PATENT DOCUMENTS

EP 0510435 A1 * 10/1992 ..... B27K 3/0221
KR 10-2016-0098021 A 8/2016
WO 2016138910 A1 9/2016

OTHER PUBLICATIONS

Kim, Sung Gon; "International Search Report and Written Opinion" for PCT/IB2017/000189 dated Oct. 18, 2017; 10 pages.
(Continued)

*Primary Examiner* — William P Fletcher, III
(74) *Attorney, Agent, or Firm* — Baker & McKenzie LLP

(57) ABSTRACT

The present disclosure relates, according to some embodiments, to methods and systems for impregnating wood with a polymer solution and products thereof. In some embodiments, the present disclosure relates to a method of processing a wood piece to generate a wood product, the method comprising: (a) placing the wood piece into a reactor having a chamber pressure of a vacuum environment; (b) exposing the wood piece to a polymer solution; (c) performing an iterative process where each cycle of the iterative process comprises a pressurizing period during which the chamber pressure is increased to an increased chamber pressure and a stabilizing period during which the chamber pressure is monitored to measure a chamber pressure decrease, if any; (d) when the decrease of chamber pressure during the stabilizing period is less than or equal to the certain threshold change, normalizing the reactor chamber to a normalized pressure; and (e) setting the wood piece to generate the wood product. The present disclosure further relates to a wood product generated by a method of processing a wood piece.

16 Claims, 10 Drawing Sheets

(51) Int. Cl.
*B27K 3/10* (2006.01)
*B27K 3/34* (2006.01)

(56) References Cited

U.S. PATENT DOCUMENTS

| | | | | | |
|---|---|---|---|---|---|
| 3,986,268 | A * | 10/1976 | Koppelman | F26B 3/34 | 34/257 |
| 4,413,024 | A | 11/1983 | Miyata et al. | | |
| 5,836,086 | A * | 11/1998 | Elder | F26B 3/04 | 34/396 |
| 6,235,346 | B1 * | 5/2001 | Barnisin, Jr. | B27K 3/0214 | 427/297 |
| 2005/0013939 | A1 * | 1/2005 | Vinden | B27K 3/0214 | 427/325 |
| 2009/0142613 | A1 | 6/2009 | Cox | | |
| 2011/0305841 | A1 * | 12/2011 | Stark | A01N 25/30 | 427/351 |
| 2012/0101620 | A1 | 4/2012 | Bendiktsen et al. | | |
| 2013/0172526 | A1 * | 7/2013 | Carvajal | F27D 3/00 | 530/202 |

OTHER PUBLICATIONS

Eckelman, C.A.; "Wood Moisture Calculations"; Forestry & Natural Resources, FNR-156-W; Purdue University, Department of Forestry & Natural Resources; Feb. 25, 1997; 18 pages.

* cited by examiner

402

403

METHODS AND SYSTEMS FOR IMPREGNATING WOOD WITH A POLYMER SOLUTION AND PRODUCTS THEREOF

FIELD OF THE DISCLOSURE

The present disclosure relates, in some embodiments, to methods and systems of impregnating a wood piece with a polymer solution to generate a wood product having one or more improved properties (e.g., density, compressive strength, bending strength).

BACKGROUND OF THE DISCLOSURE

To meet an ever increasing demand for products made of wood, manufacturers of such products are often forced to resort to using wood produced from rapidly growing plantation trees (e.g., pine, ash, *eucalyptus*, Acacia). However, plantation wood (i.e., wood derived from a plantation tree) may have qualities that are unsuitable for manufacturing high quality wooden products. For example, wood derived from rapidly growing plantation trees may have decreased density, compressive strength, bending strength, or a combination thereof.

Current methods used to remedy these disadvantages includes chemical impregnation of a plantation wood's tissues with monomers followed by polymerization of the monomers inside the wood. The success of this process is limited as one cannot achieve complete polymerization of monomers inside a wood tissue. As a result monomers may evaporate resulting in undesirable consequences such as: foul or unpleasant odors; irritation of a users eyes, skin, or mucous membranes; and/or general harm to a user's health.

SUMMARY

The present disclosure relates to methods and systems of impregnating a wood piece with a polymer solution to generate a wood product having at least one improved quality (e.g., density, compressive strength, bending strength). In some embodiments, the present disclosure relates to methods of impregnating wood with a polymer solution to yield a wood product having improved density or strength (e.g., compressive strength, bending strength) as compared to untreated wood or wood treated using a monomer solution.

The present disclosure relates, in some embodiments, to a method of processing a wood piece to generate a wood product, the method including: (a) placing the wood piece into a reactor having a chamber pressure of a vacuum environment; (b) exposing the wood piece to a polymer solution; (c) performing an iterative process where each cycle of the iterative process comprises a pressurizing period during which the chamber pressure is increased to an increased chamber pressure and a stabilizing period during which the chamber pressure is monitored to measure a chamber pressure decrease, if any, (d) when the decrease of chamber pressure during the stabilizing period is less than or equal to the certain threshold change, normalizing the reactor chamber to a normalized pressure; and (e) setting the wood piece to generate the wood product. According to some embodiments, an iterative process may include the following steps: (i) increasing a chamber pressure during a pressurizing period by a value less than or equal to a maximum pressure change (e.g., about 5 atm for a pine wood piece, about 7 atm for an ash wood piece) to the increased chamber pressure for a cycle; (ii) monitoring the chamber pressure during a stabilizing period to determine a magnitude of the chamber pressure decrease, if any, from the increased chamber pressure for the cycle; and (iii) if the decrease of chamber pressure during the stabilizing period for the cycle is more than a certain threshold range, repeat these steps (i) through (iii).

In some embodiments of the present disclosure, a method of processing a wood piece to generate a wood product may include drying a wood piece to a specified moisture content (e.g., less than about 12%) before the step (a). A method of processing a wood piece to generate a wood product, in some embodiments, may include decreasing a temperature (e.g., less than about 5° C.) surrounding the wood piece to a value below ambient temperature prior to exposing the wood piece to a vacuum environment.

The present disclosure relates, in some embodiments, to a method of processing a wood piece to generate a wood product including before the step (c), but after the step (b), exposing the wood piece to an ambient pressure for a dwell time. In some embodiments, a dwell time may be between 15 min and 30 min.

In some embodiments, a method of processing a wood piece to generate a wood product may include maintaining the wood piece at a normalized pressure for a period between about 12 h and 24 h. A method of processing a wood piece to generate a wood product, in some embodiments, may include drying the wood piece in a vacuum drying kiln.

According to some embodiments a polymer solution may be selected from the group consisting of melamine polymer, urea-formaldehyde polymer, phenol-formaldehyde polymer, melamine formaldehyde polymer, and any combination thereof. In some embodiments, a polymer solution may include one or more additives selected from the group consisting of lignin, ash, industrial color, and any combination thereof. A polymer solution, in some embodiments, may have a viscosity of less than about 300 cP. According to some embodiments, a polymer solution may have a polymer content of less than about 60% (w/w). A polymer solution, in some embodiments, may have a pH value between about 8.5 and about 9.5.

The present disclosure relates, in some embodiments to a wood product generated by a method including: (a) placing the wood piece into a reactor having a chamber pressure of a vacuum environment; (b) exposing the wood piece to a polymer solution; (c) performing an iterative process where each cycle of the iterative process comprises a pressurizing period during which the chamber pressure is increased to an increased chamber pressure and a stabilizing period during which the chamber pressure is monitored to measure a chamber pressure decrease, if any, (d) when the decrease of chamber pressure during the stabilizing period is less than or equal to the certain threshold change, normalizing the reactor chamber to a normalized pressure; and (e) setting the wood piece to generate the wood product. According to some embodiments, an iterative process may include the following steps: (i) increasing a chamber pressure during a pressurizing period by a value less than or equal to a maximum pressure change (e.g., about 5 atm for a pine wood piece, about 7 atm for an ash woof piece) to the increased chamber pressure for a cycle; (ii) monitoring the chamber pressure during a stabilizing period to determine a magnitude of the chamber pressure decrease, if any, from the increased chamber pressure for the cycle; and (iii) if the decrease of chamber pressure during the stabilizing period for the cycle is more than a certain threshold range, repeating steps (i) through (iii). According to some embodiments, a wood piece may be pine, and may have an improved quality consisting of a quality selected from: a density of between 0.4 g/cm$^3$ and 1.3 g/cm$^3$, a compressive strength of between 30 MPa and 70 MPa, a bending strength of between 60 MPa and 110 MPa, a formaldehyde content of less than 0.1%, a percent of wood vessels filled with a hardened polymer of more than 75%, and any combination thereof.

BRIEF DESCRIPTION OF THE DRAWINGS

Some embodiments of the disclosure may be understood by referring, in part, to the present disclosure and the accompanying drawings, wherein.

DETAILED DESCRIPTION

The present disclosure relates to methods and systems for impregnating a wood piece with a polymer solution to generate a wood product having at least one improved quality (e.g., density, compressive strength, bending strength).

According to some embodiments, a wood piece may be derived from a plantation tree (e.g., pine, ash, *eucalyptus*, acacia). However, the methods described herein can be applied to various types of wood and are not limited to a wood piece derived from a plantation tree. The embodiment described herein will apply to wood pieces regardless of how they are cut. For example, a wood piece may be cut to a variety of dimensions and shapes without deviating from the present disclosure. A wood piece may have a moisture content of greater than 0%, or greater than 10%, or greater than 20%, or greater than 30%, or greater than 40%, or greater than 50%, in some embodiments.

Figure 1:
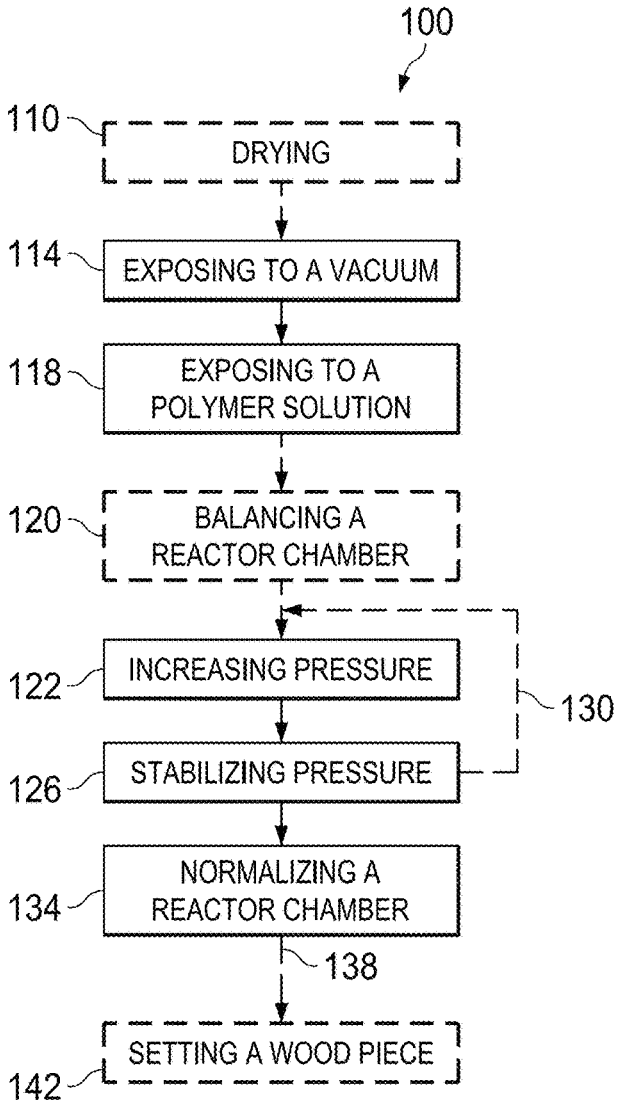
FIG. 1 provides a flow diagram illustrating a method for impregnating a wood piece with a polymer solution to produce a wood product having at least one improved quality according to a specific example embodiment of the disclosure.

FIG. 1 is a flow diagram illustrating a method for impregnating a wood piece with a polymer solution to produce a wood product having at least one improved quality, according to one embodiment of the disclosure.

In some embodiments, a moisture content of a wood piece may be modified to a specified value (e.g., 12%). According to some embodiments, a wood piece may have a moisture content that is desirable as is and thereby modification (e.g., a drying process) may be unnecessary.

As shown in FIG. 1, in some embodiments a wood piece may be subjected to a drying process 110 to reduce a moisture content. The embodiment described herein will apply to drying wood pieces by any method. For example, a drying process 110 may include any number of techniques and methods including natural drying (e.g., evaporation, exposure to heat), kiln drying, superheat steam drying (e.g., at a temperature higher than 100° C.), microwave drying, high-frequency drying, and solar drying. Various methods and equipment may be used to perform a drying process 110 (e.g., different types of wood, maximizing efficiency) and are encompassed by the present disclosure. In some embodiments, a drying process may include exposing a wood piece to increased temperatures and/or pressures. Conditions selected for a drying process may be selected according to specific characteristics of a wood piece (e.g., species of wood, present moisture content) and/or other factors (e.g., energy efficiency, production requirements, equipment specifications).

In some embodiments, a wood piece having a lower moisture content (e.g., 12%) may be capable of absorbing a larger quantity of a polymer solution than a wood piece having a higher moisture content (e.g., 50%). According to some embodiments, a drying process 110 may be used to lower a moisture content of a wood piece to less than 50%, or less than 40%, or less than 30%, or less than 20%, or less than 18%, or less than 15%, or less than 14%, or less than 13%, or less than 12%, or less than 11%, or less than 10%, or less than 9%, or less than 8%. A moisture content of a wood piece may be between 0% and 4%, or between 4% and 8%, or between 8% and 12%, or between 8% and 14%, or between 10% and 20%, or between 10% and 18%, or between 10% and 16%, or between 10% and 14%, or between 10% and 12%, or between 11% and 15%, or between 11% and 14%, or between 11% and 13%, according to some embodiments.

In some embodiments, a drying process may include exposing a wood piece to an elevated external temperature. An elevated external temperature may be greater than 30° C., or greater than 40° C., or greater than 50° C., or greater than 60° C., or greater than 70° C., or greater than 80° C., or greater than 90° C., or greater than 100° C., or greater than 110° C.

A drying process, in some embodiments, may include rapidly decreasing an external temperature surrounding a wood piece after the wood piece reaches a selected moisture content. A wood piece exposed to a rapid decrease of an external temperature may be capable of absorbing a larger quantity of a polymer solution than a wood piece having been cooled at a slower rate. According to some embodiments, a drying process 110 may comprise exposing a wood piece to an external temperature drop of about 5° C. per minute, or about 7° C. per minute, or about 10° C. per minute, or about 12° C. per minute, or about 15° C. per minute, or about 20° C. per minute, or about 25° C., or about 30° C., or about 40° C. per minute, or about 50° C. per minute. A rapid decrease of an external temperature surrounding a wood piece, in some embodiments, may include exposing the wood piece to temperatures at or below ambient temperature (e.g., 23° C.), for example a wood piece may be exposed to an external temperature of less than about 26° C., or less than about 23° C., or less than about 20° C., or less than about 18° C., or less than about 15° C., or less than about 10° C., or less than about 5° C., or less than about 2°

C. Any number of known techniques may be used to generate a rapid decrease in an external temperature surrounding a wood piece. For example, a drying kiln may be rapidly cooled by directly pumping liquidized $CO_2$ or liquidized inert gas into the kiln. In this paragraph "about" is defined as plus or minus 3° C.

According to some embodiments, a drying process 110 may include maintaining a reduced external temperature (e.g., less than an elevated temperature) surrounding a wood piece until an exterior surface temperature of the wood piece is equivalent to (e.g., plus or minus 3° C.) an internal temperature of the wood piece. A reduced external temperature, in some embodiments may be less than 30° C., or less than 26° C., or less than 23° C., or less than 20° C., or less than 18° C., or less than 15° C., or less than 12° C., or less than 10° C., or less than 8° C., or less than 5° C. A drying process 110, in some embodiments, may include maintaining a wood piece at ambient temperature (e.g., 23 C) until an exterior surface temperature of the wood piece is equivalent to (e.g., plus or minus 3° C.) an internal temperature of the wood piece.

As shown in FIG. 1, a method for impregnating a wood piece with a polymer solution to produce a wood product having at least one improved quality may include exposing a wood piece to a vacuum environment 114. Exposing a wood piece to a vacuum environment 114 may vacate one or more vessels (e.g., removing air or water or solutes from a vessel) thereby allowing the one or more vessels to absorb a quantity of a polymer solution. In some embodiments, exposing a wood piece to a vacuum environment may involve placing or maintaining a wood piece in a reactor chamber and decreasing a chamber pressure to a vacuum environment (e.g., less than 1 atm). A vacuum environment, in some embodiments, may include an environment (e.g., a reaction chamber) having a pressure of less than 1 atmospheric pressure (atm), or less than 0.8 atm, or less than 0.6 atm, or less than 0.4 atm, or less than 0.2 atm, or less than 0.1 atm, or less than 0.08 atm.

According to some embodiments, exposing a wood piece to a vacuum environment 114 may include maintaining a wood piece in a vacuum environment for a period of at least five minute (min), or at least 10 min, or at least 15 min, or at least 10 min, or at least 25 min, or at least 30 min.

As shown in FIG. 1, in some embodiments a wood piece may be exposed to a polymer solution 118. According to some embodiments, exposing a wood piece to a polymer solution 118 may involve inserting the polymer solution into a reactor chamber (e.g., a pressure proof reactor chamber) having a vacuum environment. Exposing a wood piece to a polymer solution (e.g., in a vacuum environment) may allow a quantity of the polymer solution to be absorbed into one or more vessels of the wood piece (e.g., impregnating a wood piece with a polymer solution). According to some embodiments, a wood piece may be weighted or secured within a reactor chamber to ensure that a polymer solution is capable of directly contacting the wood piece on all sides (e.g., preventing a wood piece from floating on a surface of a polymer solution).

In some embodiments, introducing a polymer solution into a reactor chamber having a vacuum environment may increase a chamber pressure (e.g., to ambient pressure). Introducing a polymer solution into a reactor chamber may increase a chamber pressure to an ambient pressure (e.g., 1 atm), in some embodiments. Some embodiments may include maintaining a chamber pressure at an ambient pressure (e.g., 1 atm) for a dwell time. A dwell time, in some embodiments, may lie between 0 min and 5 min, or between 5 min and 10 min, or between 10 min and 15 min, or between 15 min and 20 min, or between 20 min and 25 min, or between 25 min and 30 min.

A polymer solution, according to some embodiments, may be a solution having one or more polymers dissolved in a solvent. In some embodiments, a polymer solution may be a urea-formaldehyde polymer solution, or a melamine-urea-formaldehyde polymer solution, or a phenol-formaldehyde polymer solution. A natural polymer solution or any suitable polymer solution may be used, in some embodiments. According to some embodiments, a solvent may be water, isopropyl alcohol, or any other suitable solvent.

According to some embodiments, a polymer solution may have a viscosity of less than about 400 centipoise (cP), or less than about 350 cP, or less than about 320 cP, or less than about 300 cP, or less than about 270 cP, or less than about 250 cP, or less than about 220 cP, or less than about 200 cP, or less than about 170 cP, or less than about 150 cP, or less than about 120 cP, or less than about 100 cP, or less than about 70 cP, or less than about 40 cP, or less than about 10 cP, where "about" represents plus or minus 15 cP. In some embodiments, a polymer solution may have a viscosity of about 400 cP, or about 350 cP, or about 320 cP, or about 300 cP, or about 270 cP, or about 250 cP, or about 220 cP, or about 200 cP, or about 170 cP, or about 150 cP, or about 120 cP, or about 100 cP, or about 70 cP, or about 40 cP, or about 10 cP, where "about" represents plus or minus 15 cP. In some embodiments, a viscosity of a polymer solution may be a viscosity at environmental temperature (e.g., a temperature of a reaction chamber).

A polymer solution, in some embodiments, may have a polymer content of less than about 70% (w/w), or less than about 60% (w/w), or less than about 50% (w/w), or less than about 40% (w/w), or less than about 30% (w/w), where "about" represents plus or minus 5%.

According to some embodiments, a polymer solution may have a pH value of about 7.5, or about 8.0, or about 8.5, or about 9.0, or about 9.5, where about represents plus or minus 0.25. A polymer solution, in some embodiments, may have a pH between about 8.0 and about 8.5, or between about 8.0 and about 9.0, or between about 8.0 and about 9.5, or between about 8.5 and about 9.5, or between about 9.0 and about 9.5, where "about" represents plus or minus 0.25.

According to some embodiments, a viscosity and/or a polymer content of a polymer solution may be modified to desirable values. For example, impregnating a wood piece having a dense wood structure (e.g., acacia) may include exposing the wood piece to a polymer solution having a lower viscosity (e.g., less than or equal to 100 cP) and/or a lower polymer content (e.g., 40%) than may be desirable for impregnating a wood piece with a less dense wood structure, where a polymer solution having a higher viscosity (e.g., 300 cP) and/or a higher polymer content (e.g., 60%) may be more desirable. TABLE 1 illustrates some example compositions of a polymer solution.

TABLE 1

Properties of example polymer solutions

| Polymer | Solvent | Viscosity of polymer solution (cP) | Polymer content of polymer solution (w/w) | pH of polymer solution |
|---|---|---|---|---|
| urea formaldehyde polymer | water | <300 | <60 | 8.5-9.5 |

TABLE 1-continued

Properties of example polymer solutions

| Polymer | Solvent | Viscosity of polymer solution (cP) | Polymer content of polymer solution (w/w) | pH of polymer solution |
|---|---|---|---|---|
| melamine-urea-formaldehyde polymer | water | <300 | <60 | 8.5-9.5 |
| phenol-formaldehyde polymer | isopropyl alcohol | <170 | <60 | 8.5-9.5 |
| phenol-formaldehyde polymer | water | <150 | <60 | 8.5-9.5 |

In some embodiments, a polymer solution may contain one or more additives (e.g., lignin, fly ash, industrial color).

According to some embodiments, a polymer solution may include a lignin additive. A lignin additive may have a viscosity, according to some embodiments, of about 90 cP, or about 100 cP, or about 110 cP, or about 120 cP, or about 130 cP, or about 140 cP, where "about" represents plus or minus 5 cP. In some embodiments, a lignin additive may have a pH in a range of about 8.0 to about 8.5, where "about" represents plus or minus 0.25. According to some embodiments, a lignin additive may have a total organic solids content (% by w/w) of about 60%, or about 65%, or about 70%, or about 75%, where "about" represents plus or minus 5%. A lignin additive, in some embodiments, may have a total organic solids content (% by w/w) of between about 60% to about 75%, or between about 65% to about 75%, or between about 65% to about 70%, where "about" represents plus or minus 5%. In some embodiments, a lignin additive may have a total inorganic solids content (% by w/w) of about 25%, or about 30%, or about 35%, or about 40%, where "about" represents plus or minus 5%. According to some embodiments, a lignin additive may have a total inorganic solids content between about 25% to about 40%, or about 30% to about 35%, or about 30% to about 40%, or about 35% to about 40%, where "about" represents plus or minus 5%. In some embodiments a lignin additive may have a black solution content (% by w/w) of about 60%, or about 65%, or about 70%, where "about" represents plus or minus 5%. A lignin additive, in some embodiments, may have a black solution content of 63% (w/w). A specific composition of a lignin additive may be selected, in some embodiments, based on one or more characteristics of a wood piece. In some embodiments, a lignin additive may comprise up to 5% (w/w), or up to 10% (w/w), or up to 15% (w/w), or up to 20% (w/w), or up to 25% (w/w), or up to 30% (w/w) of a polymer solution. In some embodiments, a wood piece impregnated with a polymer solution having a lignin additive may have improved maintenance of the wood piece's natural coloration when compared to a wood piece impregnated with a polymer solution without a lignin additive.

In some embodiments, a polymer solution may have fly ash additive. Some embodiments may include a polymer solution with an additive of fly ash in a concentration of up to 5% (w/w), or up to 10% (w/w) of a polymer solution. According to some embodiments, a wood piece impregnated with a polymer solution having fly ash additive may have improved maintenance of the wood piece's natural coloration, or improved density, or improved hardness, or any combination thereof when compared to a wood piece impregnated with a polymer solution without an ash additive.

In some embodiments, a polymer solution may have a free formaldehyde content of less than 1.5% (w/w), or less than 1.3% (w/w), or less than 1.0% (w/w), or less than 0.9% (w/w), or less than 0.8% (w/w), or less than 0.7% (w/w), or less than 0.6% (w/w), or less than 0.5% (w/w), or less than 0.4% (w/w), or less than 0.2% (w/w).

As shown in FIG. 1, in some embodiments a method for impregnating a wood piece with a polymer solution to produce a wood product having at least one improved quality (e.g., density, compressive strength, bending strength) may involve balancing a pressure inside a reactor chamber to an ambient pressure 120. According to some embodiments, an ambient pressure may be about 0.7 atm, or about 0.8 atm, or about 0.9 atm, or about 1 atm, or about 1.1 atm, or about 1.2 atm, or about 1.3 atm, with "about" representing plus or minus 0.1 atm. In some embodiments, balancing a reactor chamber 120 may occur as a natural result of exposing a wood piece to a polymer solution (i.e., the influx of the polymer solution increases the chamber pressure to an ambient pressure). According to some embodiments, balancing a reactor chamber 120 may include increasing a chamber pressure to an ambient pressure.

According to some embodiments, balancing a pressure inside a reactor chamber 120 may include maintaining an ambient pressure in the reactor chamber for a specified period of time. In some embodiments, a reactor chamber may be maintained at an ambient pressure for between 0 min and 5 min, or between 5 min and 10 min, or between 10 min and 15 min, or between 15 min and 20 min, or between 20 min and 25 min, or between 25 min and 30 min, or between 15 min and 30 min, or between 30 min and 45 min, or between 45 min and 60 min, or between 60 min and 120 min.

As shown in FIG. 1, a method for impregnating a wood piece with a polymer solution to produce a wood product having at least one improved quality (e.g., density, compressive strength, bending strength) may involve increasing a chamber pressure 122 of a reactor chamber where the reactor chamber contains a wood piece directly contacting a polymer solution. Exposing one or more wood vessels to a pressure increase may damage at least one wood vessel (e.g., leading to collapse), and a wood piece with one or more damaged wood vessels may be less capable of absorbing a quantity of a polymer solution (e.g., due to collapsed or deteriorated vessels). Accordingly, in some embodiments, a pressure increase 122 may be an increase in pressure less than or equal to a maximum pressure change, where the maximum pressure change has a value of the greatest pressure change that allows a wood piece to retain substantially undamaged wood vessels. In some embodiments, a maximum pressure change may be about 3 atm, or about 4 atm, or about 5 atm, or about 6 atm, or about 7 atm, or about 8 atm, or about 9 atm, where "about" representing plus or minus 0.5 atm. A maximum pressure change may vary depending upon a wood type. TABLE 2 illustrates some examples of a maximum pressure change. In some embodiments, increasing a pressure 122 of a chamber where the chamber contains a wood piece directly contacting a polymer solution may involve an increase of at least 3 atm per minute, or at least 4 atm per minute, or at least 5 atm per minute, or at least 6 atm per minute, or at least 7 atm per minute, or at least 8 atm per minute, or at least 9 atm per minute. According to some embodiments, increasing a pressure 122 of a chamber where the chamber contains a wood piece directly contacting a polymer solution may involve a sudden increase in pressure. For example, in some embodiments, a pressure 122 of a chamber may be increased by at least 3 atm, or at least 4 atm, or at least 5 atm, or at least 6 atm, or at least 7 atm in a period of no more than 2 min, or no more than 90 sec, or no more than 60 sec, or no more than 30 sec, or no more than 15 sec, or no more than 10 sec, or no more than 5 sec.

A chamber temperature may be maintained at a stable value during and throughout an increase in pressure 122, in some embodiments.

TABLE 2

Examples of Maximum Pressure Change

| Wood Type | Exemplary Maximum Pressure Change (atm) |
|---|---|
| Pine | 3 atm-5 atm |
| Ash | 5 atm-7 atm |
| *Acacia* | 5 atm-7 atm |

As shown in FIG. 1, a method for impregnating a wood piece with a polymer solution to produce a wood product having at least one improved quality (e.g., density, compressive strength, bending strength) may involve stabilizing a pressure 126 of a chamber where the chamber contains a wood piece directly contacting a polymer solution. According to some embodiments, stabilizing a pressure 126 may directly follow increasing a pressure by a value less than or equal to a maximum pressure change. Stabilizing a pressure 126 may allow an interior pressure of a wood piece and a chamber pressure of a reactor chamber to approach an equilibrium. In some embodiments, stabilizing a pressure 126 may allow a quantity of a polymer solution to be absorbed by one or more vessels of a wood piece. According to some embodiments, a chamber pressure will decrease as a quantity of a polymer solution absorbs into one or more vessels of a wood piece. In some embodiments, stabilizing a pressure 126 may continue until an equilibrium is reached between a chamber pressure and an interior pressure of a wood piece.

A chamber temperature may be maintained at a stable value during and throughout stabilizing a pressure 126, in some embodiments.

As shown in FIG. 1, in some embodiments increasing a pressure 122 and stabilizing a pressure 126 may be repeated one or more times 130. Repetition 130 of increasing a chamber pressure 122 by a value less than or equal to a maximum pressure change followed by stabilizing the chamber pressure 126 may allow a quantity of a polymer solution to penetrate one or more wood vessels more deeply or more completely than a single cycle or may allow a greater quantity of the polymer solution to be absorbed by the one or more wood vessels. In some embodiments, repetition 130 of a cycle of increasing a pressure 122 by a value less than or equal to a maximum pressure change followed by stabilizing a chamber pressure 126 may continue until a repetition of the cycle results in only a minor pressure decrease during stabilization (e.g., about 0.5 atm). A minor decrease in pressure during stabilization 126, according to some embodiments, may include a decrease of less than 0.8 atm, or less than 0.6 atm, or less than 0.4 atm, or less than 0.3 atm, or less than 0.2 atm, or less than 0.1 atm, or less than 0.05 atm.

According to some embodiments, a method for impregnating a wood piece with a polymer solution to produce a wood product having at least one improved quality (e.g., density, compressive strength, bending strength) may include performing an iterative process where each cycle of the iterative process includes a pressurizing period during which the chamber pressure is increased to an increased chamber pressure through a maximum pressure change and a stabilizing period during which the chamber pressure is monitored to measure a chamber pressure decrease, if any. In some embodiments, an iterative process may include: (i) increasing a chamber pressure during a pressurizing period by a value less than or equal to a maximum pressure change to the increased chamber pressure for the cycle; (ii) monitoring the chamber pressure during the stabilizing period to measure or detect a magnitude of the chamber pressure decrease, if any; and (iii) if the decrease of chamber pressure during the stabilizing period for the cycle is more than a certain threshold range, repeating steps (i) through (iii). A certain threshold range in a decrease of chamber pressure, according to some embodiments, may include a decrease of less than about 0.8 atm, or less than about 0.6 atm, or less than about 0.4 atm, or less than about 0.3 atm, or less than about 0.2 atm, or less than about 0.1 atm, or less than about 0.05 atm.

As shown in FIG. 1, a method for impregnating a wood piece with a polymer solution to produce a wood product having at least one improved quality (e.g., density, compressive strength, bending strength) may involve normalizing a chamber pressure and/or a chamber temperature of a reactor chamber 134. According to some embodiments, normalizing a reactor chamber 134 (e.g., pressure, temperature) may involve actively or passively normalizing a chamber pressure by allowing the chamber pressure to decrease to a value equivalent to an ambient pressure, where "equivalent to" represents plus or minus 0.3 atm. In some embodiments, normalizing a reactor chamber 134 may involve actively or passively allowing a chamber pressure to decrease to a value of about 0.9 atm, or about 1.0 atm, or about 1.1 atm, or about 1.2 atm, or about 1.4 atm, or about 1.6 atm, or about 1.8 atm, or about 2.0 atm, where in some embodiments "about" represents plus or minus 0.3 atm. Normalizing a chamber pressure 134 may be implemented in such a way as to minimize damage to a wood piece (e.g., structural integrity).

According to some embodiments, normalizing a reactor chamber 134 may involve actively or passively normalizing a chamber temperature by allowing the chamber temperature to decrease to a value equivalent to an ambient temperature, where "equivalent to" represents plus or minus 4° C.

As shown in FIG. 1, in some embodiments, a wood piece may be maintained at a normalized pressure and/or a normalized temperature 138 for a designated period of time. According to some embodiments, a normalized pressure may be about 0.9 atm, or about 1.0 atm, or about 1.1 atm, or about 1.2 atm, or about 1.3 atm, where in some embodiments "about" represents plus or minus 0.3 atm. Maintaining a wood piece at a normalized pressure 138, in some embodiments, may involve maintaining the wood piece at a value equivalent to an ambient pressure, where "equivalent to" represents plus or minus 0.3 atm. According to some embodiments, a wood piece may be maintained at a normalized pressure and/or a normalized temperature 138 for a designated period of at least 1 hour, or at least 2 hours, or at least 6 hours, or at least 12 hours, or at least 24 hours, or at least 36 hours, or at least 48 hours. A wood piece, according to some embodiments, may be maintained at a normalized pressure and/or a normalized temperature 134 for a period of between about 0 hours (h) and about 6 h, or between about 6 h and about 12 h, or between about 12 h and about 18 h, or between about 18 h and about 24 h, or between about 12 h and about 24 h, or between about 24 h and about 36 h, or between about 36 h and about 48 h, or between about 24 h and about 48 h, or between about 12 h and about 48 h, or between about 0 h and about 48 h, where in some embodiments "about" represents plus or minus 1 hour. A length of time for maintaining a wood piece at a normalized pressure and/or a normalized temperature may vary depending upon at least the dimensions of the wood piece, the wood type, and the specific characteristics desired (e.g., a penetration level of a polymer solution in a wood piece).

As shown in FIG. 1, according to some embodiments, a wood piece may be set 142 such that a quantity of a polymer solution absorbed by one or more vessels hardens (e.g., partial hardening, complete hardening) to generate a wood product. Conditions for setting a wood piece 142 may be selected according to specific characteristics of a polymer (e.g., hardening temperature, drying time). In some embodiments, a wood piece may be set 142 to generate a wood product by exposing the wood piece to a temperature at which a polymer solution may harden. In some embodiments, setting a wood piece 142 to generate a wood product may include exposing a wood piece to elevated external temperatures. An elevated external temperature may be greater than 30° C., or greater than 40° C., or greater than 50° C., or greater than 60° C., or greater than 70° C., or greater than 80° C., or greater than 90° C., or greater than 100° C., or greater than 110° C., or greater than 120° C., or greater than 130° C. According to some embodiments, exposing a wood piece to a temperature at which a polymer solution may harden may involve a gradual temperature increase or a rapid temperature increase. According to some embodiments, setting a wood piece 142 to generate a wood product may include maintaining an elevated external temperature surrounding a wood piece until a polymer hardens or for a specified period of time.

Setting methods known to a person skilled in the art include, but are not limited to, exposing a wood piece to a natural drying process, superheat steam drying (at a temperature higher than 100° C.), microwave drying, high-frequency drying, infrared drying, and solar drying. According to some embodiments, a setting process 142 may include using microwave or high-frequency waves in a vacuum drying kiln.

A Wood Product

Various defining properties are used to qualify the value and usefulness of wood. A wood product generated by the methods of this disclosure may have one or more improved qualities as compared to a wood piece that was not treated by the disclosed method. According to some embodiments a wood product may have improved density, or compressive strength, or bending strength, or hardness, or formaldehyde content, or percentage of filled wood vessels.

Density

In some embodiments, a wood product may have a density between 0.4 g/cm$^3$ and 0.5 g/cm$^3$, 0.5 g/cm$^3$ and 0.6 g/cm$^3$, 0.6 g/cm$^3$ and 0.7 g/cm$^3$, 0.7 g/cm$^3$ and 0.8 g/cm$^3$, or between 0.8 g/cm$^3$ and 0.9 g/cm$^3$, or between 0.9 g/cm$^3$ and 1.0 g/cm$^3$, or between 1.0 g/cm$^3$ and 1.1 g/cm$^3$, or between 1.1 g/cm$^3$ and 1.2 g/cm$^3$, or between 1.2 g/cm$^3$ and 1.3 g/cm$^3$, or between 0.4 g/cm$^3$ and 0.7 g/cm$^3$, or between 0.7 g/cm$^3$ and 1.0 g/cm$^3$, or between 1.0 g/cm$^3$ and 1.3 g/cm$^3$. In some embodiments, a wood product may have a density of more than about 0.4 g/cm$^3$, or more than about 0.5 g/cm$^3$, or more than about 0.6 g/cm$^3$, or more than about 0.7 g/cm$^3$, or more than about 0.8 g/cm$^3$, or more than about 0.9 g/cm$^3$, or more than about 1.0 g/cm$^3$, or more than about 1.1 g/cm$^3$, or more than about 1.2 g/cm$^3$, or more than about 1.3 g/cm$^3$, where "about" in some embodiments represents plus or minus 0.05 g/cm$^3$.

A wood product generated from a wood piece comprising a pine wood may have a density of more than about 0.4 g/cm$^3$, or more than about 0.5 g/cm$^3$, or more than about 0.6 g/cm$^3$, or more than about 0.7 g/cm$^3$, or more than about 0.8 g/cm$^3$, or more than about 0.9 g/cm$^3$, or more than about 1.0 g/cm$^3$, or more than about 1.1 g/cm$^3$, or more than about 1.2 g/cm$^3$, or more than about 1.3 g/cm$^3$, according to some embodiments, where "about" represents plus or minus 0.05 g/cm$^3$. In some embodiments, a wood product generated from a wood piece comprising a pine wood may have a density of between 0.4 g/cm$^3$ and 0.5 g/cm$^3$, or between 0.5 g/cm$^3$ and 0.6 g/cm$^3$, or between 0.6 g/cm$^3$ and 0.7 g/cm$^3$, or between 0.7 g/cm$^3$ and 0.8 g/cm$^3$, or between 0.8 g/cm$^3$ and 0.9 g/cm$^3$, or between 0.9 g/cm$^3$ and 1.0 g/cm$^3$, or between 1.0 g/cm$^3$ and 1.1 g/cm$^3$, or between 1.0 g/cm$^3$ and 1.2 g/cm$^3$, or between 1.2 g/cm$^3$ and 1.3 g/cm$^3$. A wood product generated from a wood piece comprising a pine wood, in some embodiments, may have a density of between 0.4 g/cm$^3$ and 1.3 g/cm$^3$.

A wood product generated from a wood piece comprising a ash wood may have a density of more than about 0.6 g/cm$^3$, or more than about 0.7 g/cm$^3$, or more than about 0.8 g/cm$^3$, or more than about 0.9 g/cm$^3$, or more than about 1.0 g/cm$^3$, or more than about 1.1 g/cm$^3$, or more than about 1.2 g/cm$^3$, or more than about 1.3 g/cm$^3$, according to some embodiments, where "about" represents plus or minus 0.05 g/cm$^3$. In some embodiments, a wood product generated from a wood piece comprising a ash wood may have a density of between 0.6 g/cm$^3$ and 0.7 g/cm$^3$, or between 0.7 g/cm$^3$ and 0.8 g/cm$^3$, or between 0.8 g/cm$^3$ and 0.9 g/cm$^3$, or between 0.9 g/cm$^3$ and 1.0 g/cm$^3$, or between 1.0 g/cm$^3$ and 1.1 g/cm$^3$, or between 1.0 g/cm$^3$ and 1.2 g/cm$^3$, or between 1.2 g/cm$^3$ and 1.3 g/cm$^3$ Compressive Strength In some embodiments, a wood product may have a compressive strength between 30 MPa and 40 MPa, between 40 MPa and 50 MPa, or between 50 MPa and 60 MPa, or between 60 MPa and 70 MPa, or between 50 MPa and 70 MPa. In some embodiments, a wood product may have a compressive strength of more than about 40 MPa, or more than about 50 MPa, or more than about 60 MPa, or more than about 70 MPa, where "about" in some embodiments represents plus or minus 5 MPa.

A wood product generated from a wood piece comprising a pine wood may have a compressive strength of more than about 30 MPa, or more than about 40 MPa, or more than about 50 MPa, or more than about 60 MPa, or more than about 70 MPa, where "about" in some embodiments represents plus or minus 5 MPa. In some embodiments, a wood product generated from a wood piece comprising a pine wood may have a compressive strength between 30 MPa and 40 MPa, 40 MPa and 50 MPa, 50 MPa and 60 MPa, or between 60 MPa and 70 MPa, or between 30 MPa and 70 MPa.

Bending Strength

In some embodiments, a wood product may have a bending strength between 60 MPa and 70 MPa, or between 70 MPa and 80 MPa, or between 80 MPa and 90 MPa, or between 90 MPa and 100 MPa, or between 100 MPa and 110 MPa, or between 80 MPa and 100 MPa, or between 85 MPa and 110 MPa. In some embodiments, a wood product may have a bending strength of more than about 60 MPa, or more than about 70 MPa, or more than about 80 MPa, or more than about 90 MPa, or more than about 110 MPa, where "about" in some embodiments represents plus or minus 5 MPa.

A wood product generated from a wood piece comprising a pine wood, in some embodiments, may have a bending strength of more than about 65 MPa, or more than about 75 MPa, or more than about 85 MPa, or more than about 95 MPa, or more than about 105 MPa, where "about" represents plus or minus 5 MPa. In some embodiments, a wood product generated from a wood piece comprising a pine wood may have a compressive strength between 65 MPa and 85 MPa, or between 75 MPa and 95 MPa, or between 85 MPa and 105 MPa, or between 80 MPa and 100 MPa, or between 75 MPa and 100 MPa, or between 60 MPa and 110 MPa.

Hardness

In some embodiments, a wood product may have a hardness between 3000 N and 4000 N, or between 4000 N and 5000 N, or between 5000 N and 6000 N, or between 6000 N and 7000 N, or between 7000 N and 8000 N, or between 8000 N and 9000 N, or between 9000 N and 13000 N, or between 3000 N and 5000 N, or between 5000 N and 9000 N, or between 4000 N and 8000 N. In some embodiments, a wood product may have a hardness of more than about 3000 N, or more than about 4000 N, or more than about 5000 N, or more than about 6000 N, or more than about 7000 N, or more than about 8000 N, or more than about 9000 N, or more than about 10000 N, or more than about 11000 N, or more than about 12000 N, where "about" in some embodiments represents plus or minus 500 N.

Formaldehyde Content

According to some embodiments, a wood product may have a formaldehyde content of less than 0.2%, or less than 0.18%, or less than 0.16%, or less than 0.14%. or less than 0.12%, or less than 0.1%, or less than 0.09%, or less than 0.08%, or less than 0.07%, or less than 0.06%, or less than 0.02%.

A wood product generated from a wood piece comprising a pine wood may have a formaldehyde content of less than 0.1%, or less than 0.09%, or less than 0.08%, or less than 0.07%, or less than 0.06%, or less than 0.05%, or less than 0.04%, or less than 0.03%, or less than 0.02%, or less than 0.01%, according to some embodiments.

Percent of Wood Vessels Filled with Polymer

In some embodiments, a wood product may have a percentage of wood vessels filled with polymer of more than 15%, more than 25%, more than 35%, more than 45%, more than 55%, more than 65%, or more than 70%, or more than 75%, or more than 80%, or more than 85%, or more then 90%, or more than 95%.

A wood product generated from a wood piece comprising a pine wood, in some embodiments, may have a percentage of wood vessels filled with polymer of more than 15%, or more than 25%, or more than 35%, or more than 45%, or more than 55%, or more than 65%, or more than 75%, or more than 80%, or more than 85%, or more then 90%, or more than 95%.

TABLE 3

Characteristics of a Wood Product

| Property | Pine |
|---|---|
| Density (g/cm$^3$) | 0.7-1.3 |
| Longitudinal compressive strength (MPa) | 30-70 |
| Statical bending strength (MPa) | 60-110 |
| Hardness (N) | 9000-12000 |

TABLE 3-continued

Characteristics of a Wood Product

| Property | Pine |
|---|---|
| Formaldehyde content (mg/100 g) | Less than 0.5% |
| Percent of wood vessels filled with polymer | More than 75% |

Systems of Impregnating a Wood Piece with a Polymer Solution to Generate a Wood Product Embodiments of the disclosure also provide systems of impregnating a wood piece with a polymer solution to generate a wood product having one or more improved properties (e.g., density, compressive strength, bending strength). Such systems may include, for example: a drying unit (e.g., 110) for drying a wood piece to a specified moisture content; a pressure-proof reactor (e.g., FIG. 2); and a setting unit (e.g., 142).

In some embodiments, a drying unit (e.g., 110) may include one or more of the following apparatuses: a kiln, an oven, a steam dryer, a microwave dryer, a high-frequency wave dryer, a solar dryer.

According to some embodiments, a pressure-proof reactor may be operable to generate a vacuum environment (e.g., 114), or adjust a chamber pressure (e.g., 122, 134), or maintain a chamber pressure (e.g., 138), or withstand changes in a chamber pressure, or any combination thereof.

Figure 2:
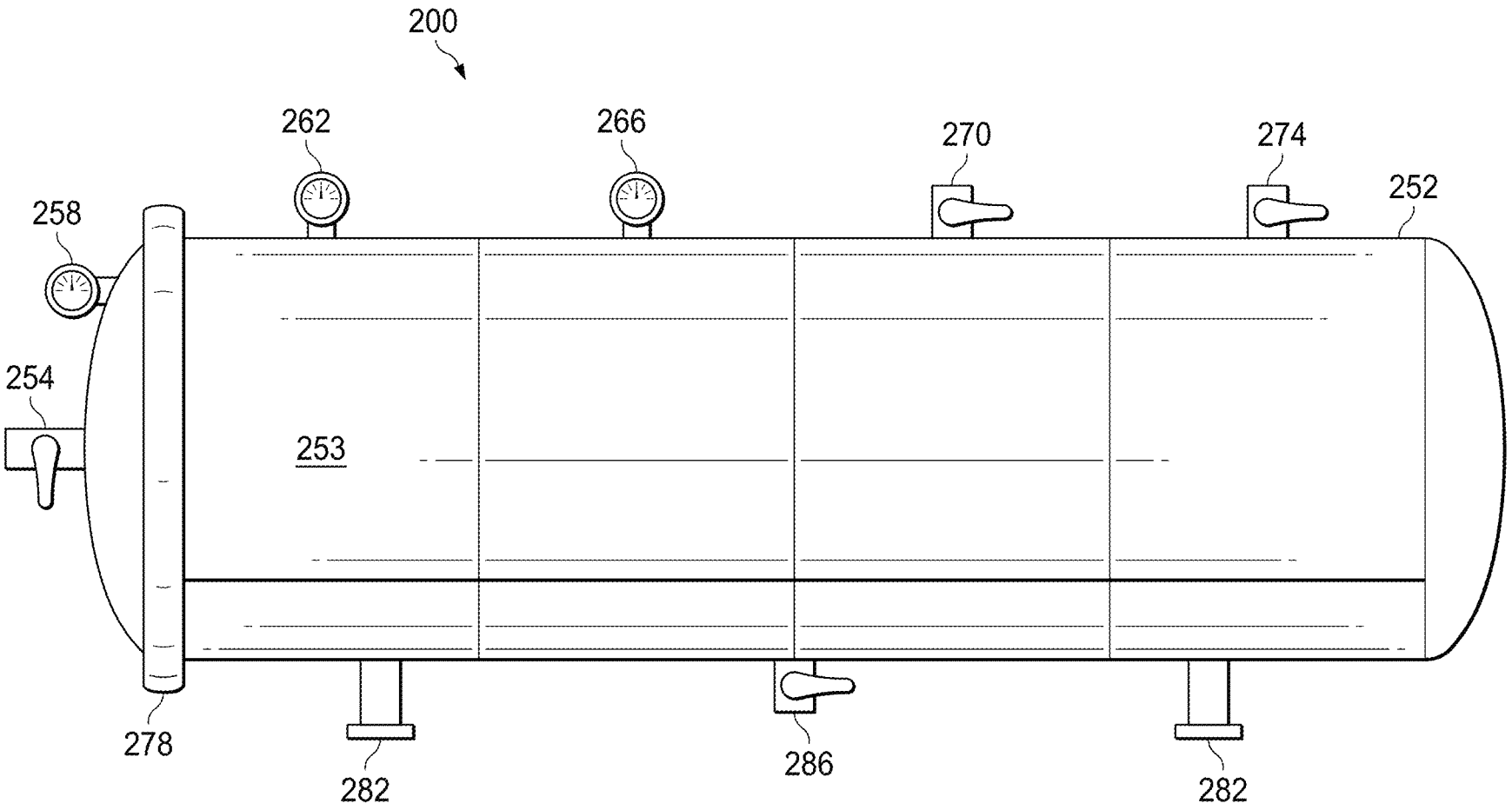
FIG. 2 illustrates a schematic view of a pressure-proof reactor, according to a specific example embodiment of the disclosure.

FIG. 2 illustrates a pressure-proof reactor 200, according to one embodiment of the disclosure. A reactor, in some embodiments, may include a casing 252, a pressure chamber 253, a connecting valve 254, a temperature gauge 258, a vacuum gauge 262, a pressure gauge 266, a discharge valve 270, a vacuum valve 274, a temperature element 278, a support base 282 and a discharge outlet 286.

According to some embodiments, pressure-proof reactor 200 may include casing 252 operable to retain and/or release pressure. Casing 252 may be composed of steel (e.g., engineering grade), in some embodiments. In some embodiments, casing 252 may have a first layer and a second layer, and may include an insulating material (e.g., glass wool) between the first layer and the second layer. As shown in FIG. 2, in some embodiments, casing 252 may enclose a pressure chamber 253 operable to retain pressure and/or liquid and/or gases. Pressure proof reactor 200 may be physically supported or leveled by one or more support bases 282.

According to some embodiments, a pressure proof reactor may include a connecting valve 254 operable to releasably connect pressure chamber 253 to an external source of a liquid or gas. For example, connecting valve 253 may releasably connect a polymer solution tank (not illustrated) to pressure chamber 253 thereby allowing a polymer solution to be inserted into pressure chamber 253. As shown in FIG. 2, pressure-proof reactor 200 may further include discharge outlet 286 which may be operable to release liquids (e.g., polymer solution) or gases from pressure chamber 253.

In some embodiments, a pressure proof reactor may include a temperature element 278 operable to modify a temperature in pressure chamber 253. According to some embodiments, a temperature element 278 may comprise a steam pipe system (e.g., allocated between a first layer and a second layer of casing 252) which may be operable to heat pressure chamber 253.

According to some embodiments, pressure valve 274 may connect pressure chamber 253 to an external pressure source, such as a vacuum pump (not shown), an air compressor (not shown), or a liquid $CO_2$ cylinder (not shown). In some embodiments, a high-pressure pipe system may be connected to pressure chamber 253 by pressure valve 274. Pressure valve 274 may be operable, in some embodiments, to regulate changes (e.g., increase, decrease) in pressure within pressure chamber 253. In some embodiments, discharge valve 270 may connect pressure chamber 253 to an external environment or an external storage container. Discharge valve 270 may be operable to regulate decreases in pressure within pressure chamber 253 (e.g., venting).

In some embodiments, pressure gauge 266 may be connected to pressure chamber 253 and may be operable to monitor pressure and/or pressure changes within pressure chamber 253. According to some embodiments, vacuum gauge 262 may be connected to pressure chamber 253 and may be operable to monitor pressure and/or pressure changes within pressure chamber 253. In some embodiments, vacuum gauge 262, a pressure gauge 266, and a vacuum pump/air compressor connected to pressure valve 274, may for a pressure element and may be operable to adjust a chamber pressure.

A pressure-proof reactor may include other components and/or elements (e.g., system safety valves, wood loading gate) while still remaining within the scope of the present disclosure. Moreover, FIG. 2 is to be understood as an example. A suitable pressure-proof reactor may be constructed differently.

In some embodiments, a setting unit (e.g., 142) may include one or more of the following apparatuses: a kiln, an oven, a steam dryer, a microwave dryer, a high-frequency wave dryer, a solar dryer.

It is understood that the listed apparatuses for each unit are for illustration purposes only, and this is not intended to limit the scope of the application. A specific combination of these or other apparatuses or units can be configured in such a system for the intended use based on the teachings in the application.

Various changes may be made without deviating from the scope of the present disclosure. For example, various changes in the disclosed temperatures, duration, pressures, number of cycles, types of wood, and/or arrangement of parts may be made without departing from the scope of the instant disclosure. Each disclosed method and method step may be performed in association with any other disclosed method or method step and in any order according to some embodiments. Where the verb "may" appears, it is intended to convey an optional and/or permissive condition, but its use is not intended to suggest any lack of operability unless otherwise indicated. Various changes may be made in methods of preparing and using a composition, device, and/or system without deviating from the scope of the present disclosure. Where desired, some embodiments of the disclosure may be practiced to the exclusion of other embodiments.

For the purposes of this disclosure, the use of the term "stable" and related terms such as "stabilized" are used with the standard definition of the term. For example, a stable temperature would require the temperature to have a value within an acceptable tolerance range around a set point over a defined period of time. The acceptable tolerance can vary, depending on the application.

For the purposes of this disclosure, ambient temperature and ambient pressure are in the range of between 10° C. and 45° C. and 1 atm±0.3 atm, respectively.

Also, where ranges have been provided, the disclosed endpoints may be treated as exact and/or approximations (e.g., read without or with "about") as desired or demanded by the particular embodiment. In addition, it may be desirable, in some embodiments, to mix and match range endpoints. These equivalents and alternatives along with obvious changes and modifications are intended to be included within the scope of the present disclosure. Accordingly, the foregoing disclosure is intended to be illustrative, but not limiting, of the scope of the disclosure as illustrated by the appended claims.

The title, abstract, background, and headings are provided in compliance with regulations and/or for the convenience of the reader. They include no admissions as to the scope and content of prior art and no limitations applicable to all disclosed embodiments.

EXAMPLES

A specific example embodiment of the disclosure is illustrated by the example herein.

Example 1: Processing Pine Wood

An example embodiment of the present invention as applied to pine wood.

As a first step, wood pieces required for the experiment were acquired by extracting wood blocks from peeled fresh pine timber. These wood blocks were further cut into pine strips measuring 90 cm×20 cm×2 cm. Three identical strips were selected. In this example, these pine strips are referred to as strips 1, 2, and 3, respectively. Each of the pine strips, 1, 2, and 3, was cut into five wood pieces, as depicted in FIG. 4 (illustrating a single example strip).

Figure 4:
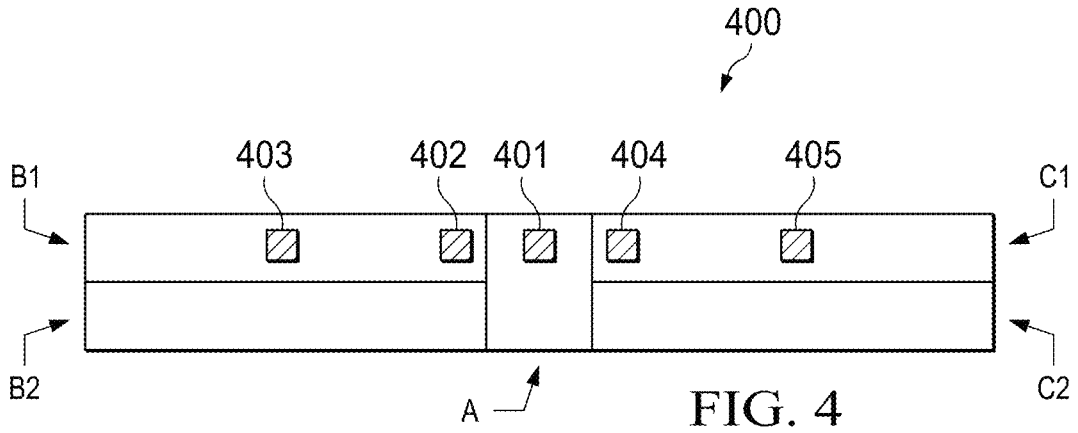
FIG. 4 is a representation of an aerial view of a wood strip, according to a specific example embodiment of the disclosure.

As shown in FIG. 4, a pine strip was cut into five wood pieces which were designated as A, B1, B2, C1, and C2. The wood pieces were labeled to retain the relative orientation of the five pieces to one another. The wood pieces B1, B2, C1, and C2 each had dimensions of about 40 cm×10 cm×2 cm, and wood piece A measured about 10 cm×20 cm×2 cm. The technical properties of wood piece A are shown in TABLE 4.

TABLE 4

Technical properties of wood piece A (moisture content of 14%).

| Technical properties | | Value |
|---|---|---|
| Density (g/cm$^3$) | | 0.497 |
| Contraction (%) | Radial | 3.05 |
| | Tangent | 7.50 |
| | Volume | 11.68 |
| Coefficient of contraction | Radial | 0.22 |
| | Tangent | 0.53 |
| | Volume | 0.83 |
| Expansion (%) | Radial | 3.76 |
| | Tangent | 7.21 |
| | Volume | 12.11 |
| Coefficient of expansion | Radial | 2.93 |
| | Tangent | 4.41 |
| | Volume | 7.84 |
| Compressive strength (MPa) | | 28.1 |
| Bending strength (MPa) | | 78.5 |

Figure 5A:
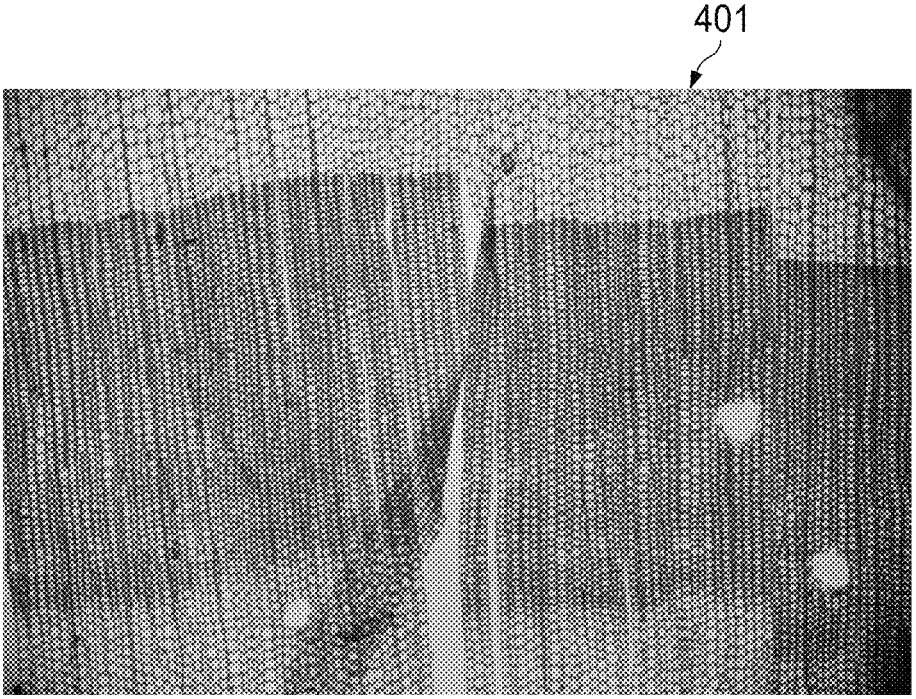
FIGS. 5A, 5B, and 5C are each a microscope image of a portion of a wood piece, according to a specific example embodiment of the disclosure.
Figure 5B:
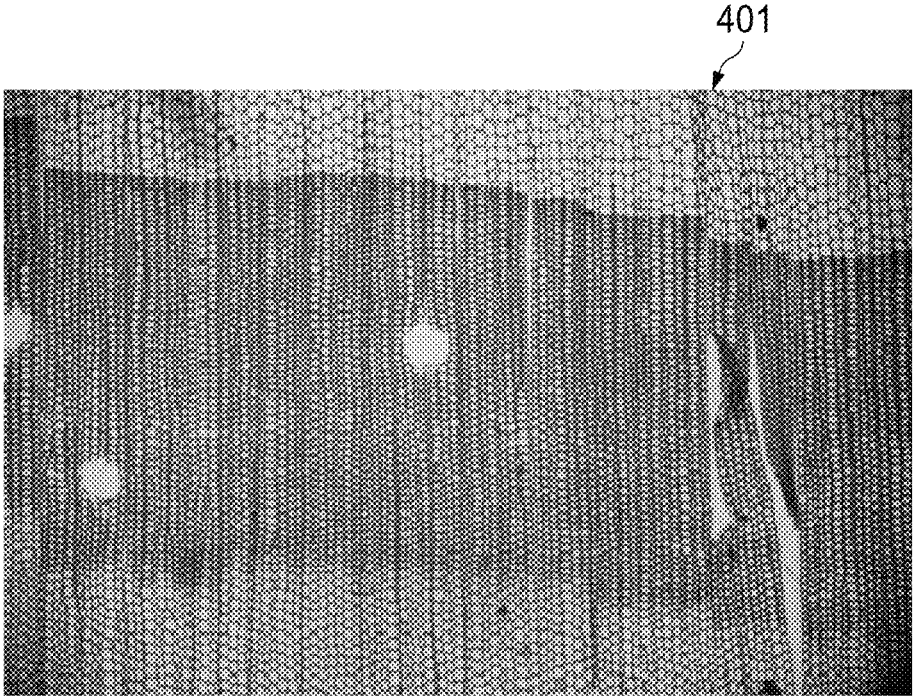
Figure 5C:
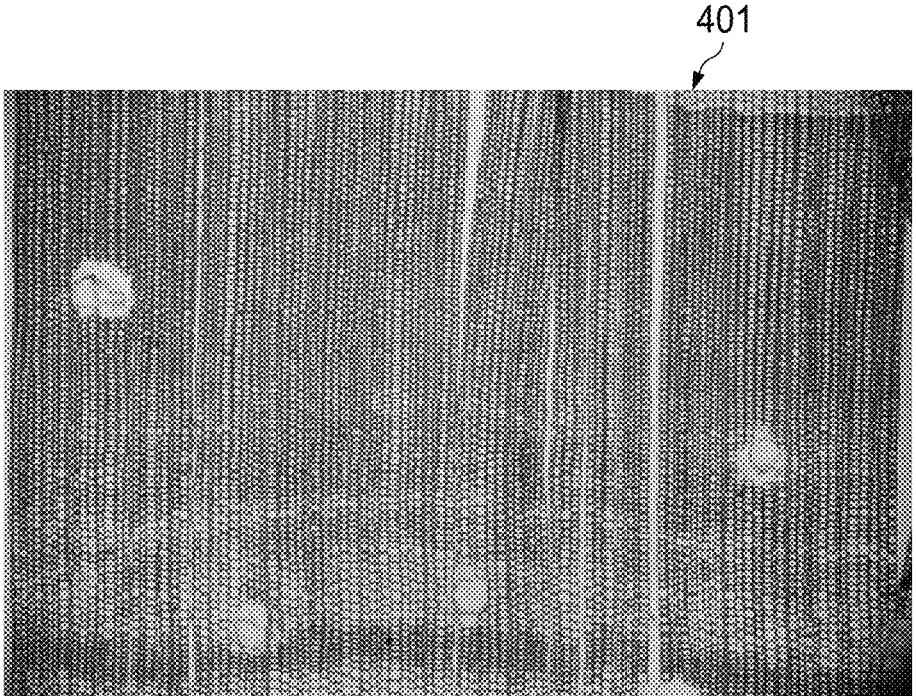

Wood piece A from each of the three pine strips was not processed, but instead a sample was taken from area 401 of each piece. The samples 401 (e.g., FIGS. 5A, 5B, 5C) served as a control for comparison to samples that were impregnated with a polymer solution (e.g., FIGS. 6A, 6B, and 6C, FIGS. 7A, 7B, and 7C, FIGS. 8 A, 8B, and 8C, FIGS. 9A, 9B, and 9C). Wood pieces A from the three strips were further divided into pieces measuring about 1 cm×1 cm×2 cm. Additionally, area 401 was sliced to provide a sample of 20 to 25 μm thickness which was analyzed using a microscope, as shown in FIGS. 5A, 5B, and 5C (illustrating area 401 from pine strips 1, 2, and 3 respectively). FIGS. 5A, 5B, and 5C provide photos of cross-sectional views of the 20 μm to 25 μm thick samples taken from wood piece A area 401 of the three pine strips. FIGS. 5A, 5B, and 5C illustrate the empty wood vessels of the untreated area 401 of the wood pieces.

Wood pieces B1, B2, C1, and C2 of pine strips 1, 2, and 3, as shown in FIG. 4, were processed according to one embodiment of this disclosure. First, the wood pieces were placed in a drying kiln and dried to a moisture content of about 12%.

Next, the wood pieces were placed in a pressure-proof reactor, such as is shown in FIG. 2. Due to the lightness of the pine wood, the wood pieces were fastened to an iron bar heavy enough to keep the wood pieces at the bottom of the reactor during processing and thereby ensuring that the polymer solution would contact all sides of the wood pieces (i.e., the wood pieces would not float). The pressure element of the reactor was activated in order to create a vacuum (approximately 0.01 atm) inside the reactor chamber.

Following the generation of a vacuum environment within the reaction chamber, a polymer solution was inserted into the reactor chamber and allowed to completely coat the wood pieces. The polymer solution in this example embodiment had a urea-formaldehyde-melamine content of 50%±5% (w/w), a viscosity of 120 cP±5 cP, and a pH of 8.5±0.2. The free formaldehyde content of the polymer solution was less than 0.9%, and the solution solvent was water. As the polymer solution was introduced into the reaction chamber, the chamber pressure increased. The chamber pressure was further increased until it reached ambient pressure by activating the pressure element. The pine wood pieces were maintained in direct contact with the polymer solution in an ambient pressure environment for 15 minutes.

Figure 3:
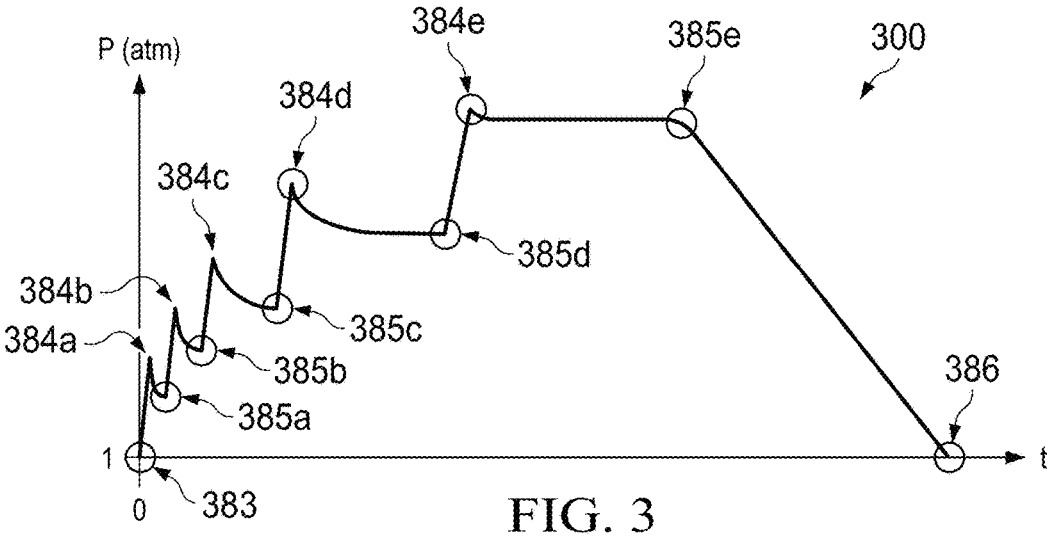
FIG. 3 illustrates a pressure profile, according to a specific example embodiment of the disclosure.

The pressure inside the reactor was increased by specific values in accordance with the pressure profile shown in FIG. 3 and described below, thus allowing the polymer solution to fill the majority of the wood vessels. The pressure profile 300 of FIG. 3 illustrates time on the x-axis and pressure on the y-axis. The pressure profile 300 begins at point 383 where the time axis crosses the pressure axis, i.e. approximately ambient pressure (e.g., 1.0 atm). The chamber pressure containing the wood pieces B1, B2, C1, and C2 submerged in the polymer solution was rapidly increased by a value less than or equal to the maximum pressure change for pine wood piece to the pressure value of point 384*a*. Specifically, the first pressure change was an increase to about 5 atm over a period of half a minute. The difference in value between point 383 and point 384*a* is less than or equal to the maximum pressure change for pine (5 atm±0.2 atm). As shown in FIG. 3, the pressure increase (e.g., 122) was followed by a pressure stabilizing process (e.g., 126) where the pressure decreased and stabilized at point 385*a*. Specifically, the pressure decreased over half a minute and stabilized at around 3 atm.

A second pressure increase (e.g., 122/130) having a value less than or equal to the maximum pressure change culminated at point 384*b*. The second pressure increase was followed by a second pressure stabilizing process (e.g., 126/130) where the pressure decreased and stabilized at point 385*b*. Specifically, the second pressure increase was to about 7 atm over half a minute, with the pressure decreasing over half a minute and stabilizing at 5 atm.

The wood pieces were subjected to a third pressure increase (e.g., 122/130) having a value less than or equal to the maximum pressure change and culminating at point 384*c*, followed by a third pressure stabilizing process (e.g., 126/130) where the pressure decreased and stabilized at point 385*c*. Specifically, the third pressure increase raised the chamber pressure to about 9 atm over the period of one minute. The third pressure stabilized to about 7 atm over a period of 7 min.

Next the wood pieces were exposed to a fourth pressure increase (e.g., 122/130) having a value less than or equal to the maximum pressure change and culminating at point 384*d*, followed by a fourth pressure stabilizing process (e.g., 126/130) where the pressure decreased and stabilized at point 385*d*. Specifically, the fourth pressure increase raised the chamber pressure to about 12 atm, over a period of 1 min, followed by stabilization of the chamber pressure to about 10 atm over a period of 10 min.

As shown in FIG. 3, the wood pieces were exposed to a fifth pressure increase (e.g., 122/130) having a value less than or equal to the maximum pressure change and culminating at point 384*e*, followed by a fifth pressure stabilizing process (e.g., 126/130) where the pressure decreased and stabilized at point 385*e*. The fifth pressure increase was done over a period of a minute and culminated at a chamber pressure of 15 atm. The pressure stabilized at about 14.5 atm in less than 30 s. The wood pieces were maintained at a chamber pressure of about 14.5 atm for 20 min.

The maximum pressure change for pine wood is 5 atm±0.2 atm. Neither the first pressure increase, nor the second pressure increase, nor the third pressure increase, nor the third pressure increase, nor the fourth pressure increase, nor the fifth pressure increase (each described in EXAMPLE 1) was permitted to exceed a maximum pressure change of 5 atm.

Finally, as shown in FIG. 3, the chamber pressure was normalized (e.g., 134) to ambient pressure at point 386.

After completion of the impregnation process, the wood pieces were stored in ambient pressure and temperature for about 24 hours. Wood pieces B1 and B2 were not processed further (i.e., setting was limited to that which would occur at ambient temperature in a period of 24 hours). Two samples of the impregnated wood were taken from wood piece B1 of each of pine strips 1, 2, and 3. The locations of the samples are shown in FIG. 4, marked 402 and 403. The wood pieces of region B1 were cut into pieces of about 1 cm×1 cm×2 cm. Sample 402 was selected from the region that would have corresponded to about 1 cm from the boundary with wood piece A if the wood pieces were oriented based on their initial locations (see FIG. 4). Sample 403 was selected from the region that would have corresponded to about 20 cm from the boundary with wood piece A if the wood pieces were oriented based on their initial locations (see FIG. 4). A cross-section of the samples having a thickness of 20 μm to 25 μm was taken from each of the six samples (3 samples of 402 from pine strip 1, 2, and 3 respectively and 3 samples of 403 from pine strip 1, 2, and 3 respectively). All six samples were microscopically analyzed.

Figure 6A:
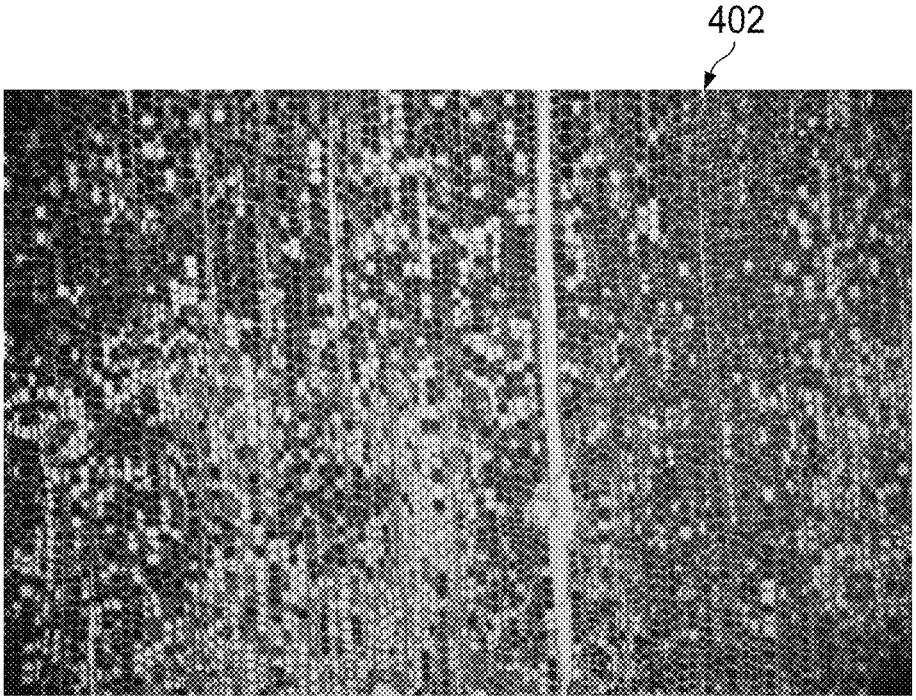
FIGS. 6A, 6B, and 6C are each a microscope image of a portion of a wood piece, according to a specific example embodiment of the disclosure.
Figure 6B:
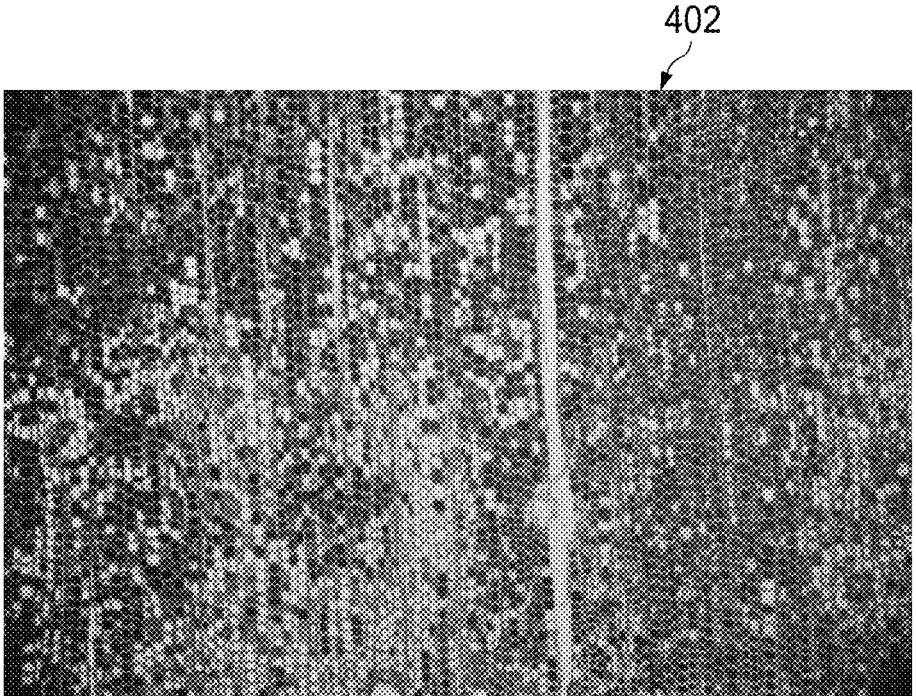
Figure 6C:
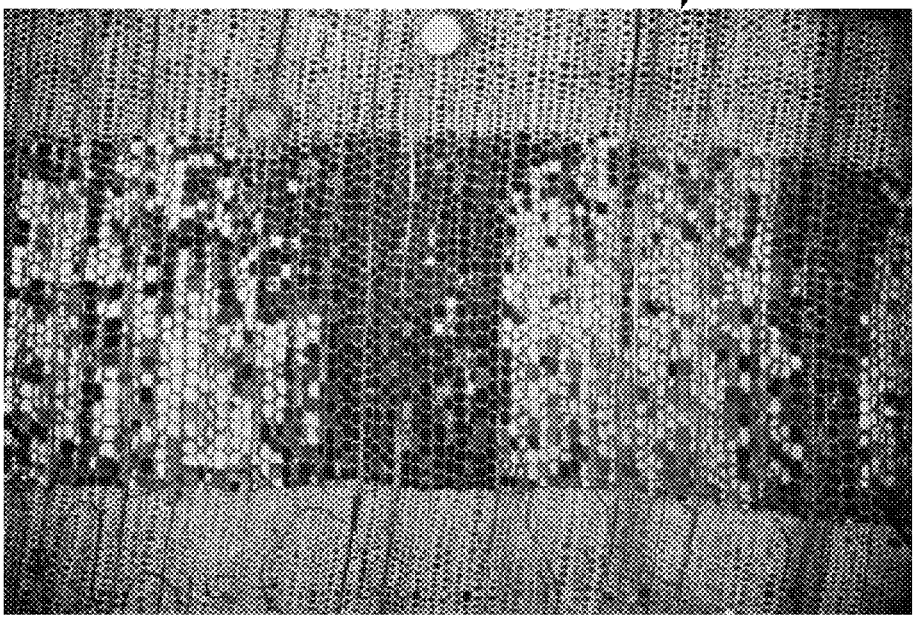
Figure 7A:
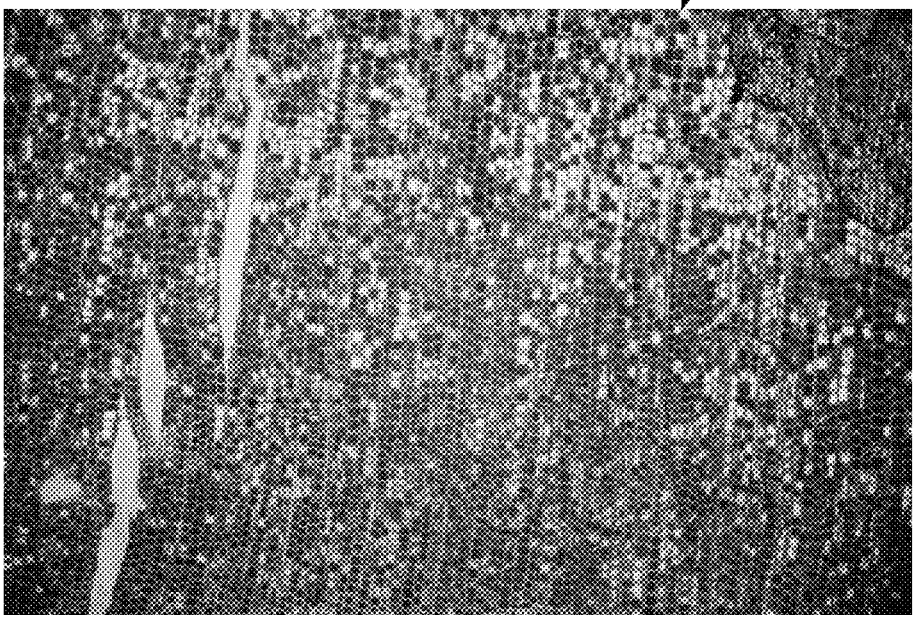
FIGS. 7A, 7B, and 7C are each a microscope image of a portion of a wood piece, according to a specific example embodiment of the disclosure.
Figure 7B:
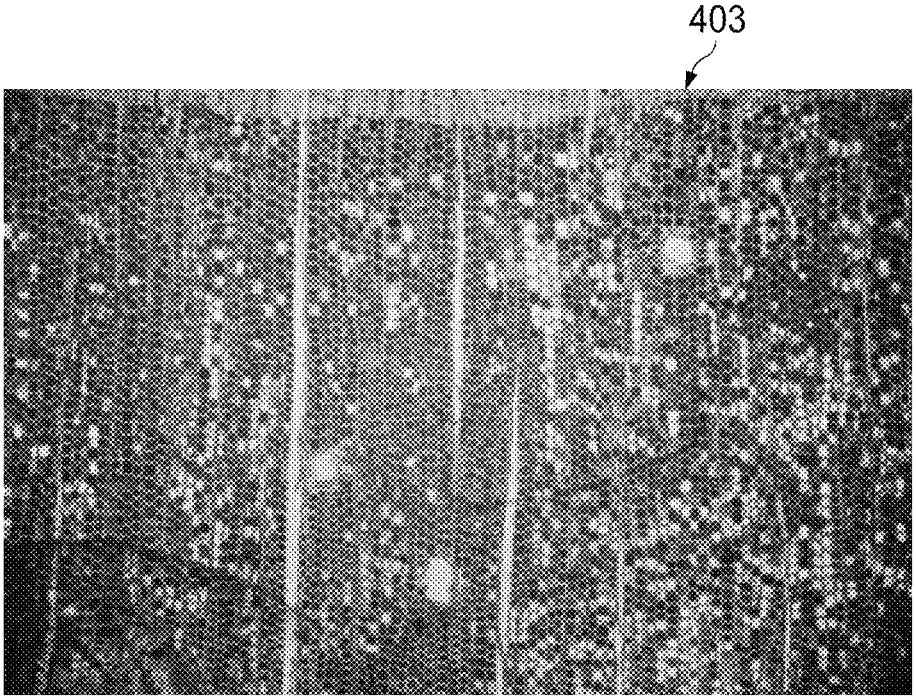
Figure 7C:
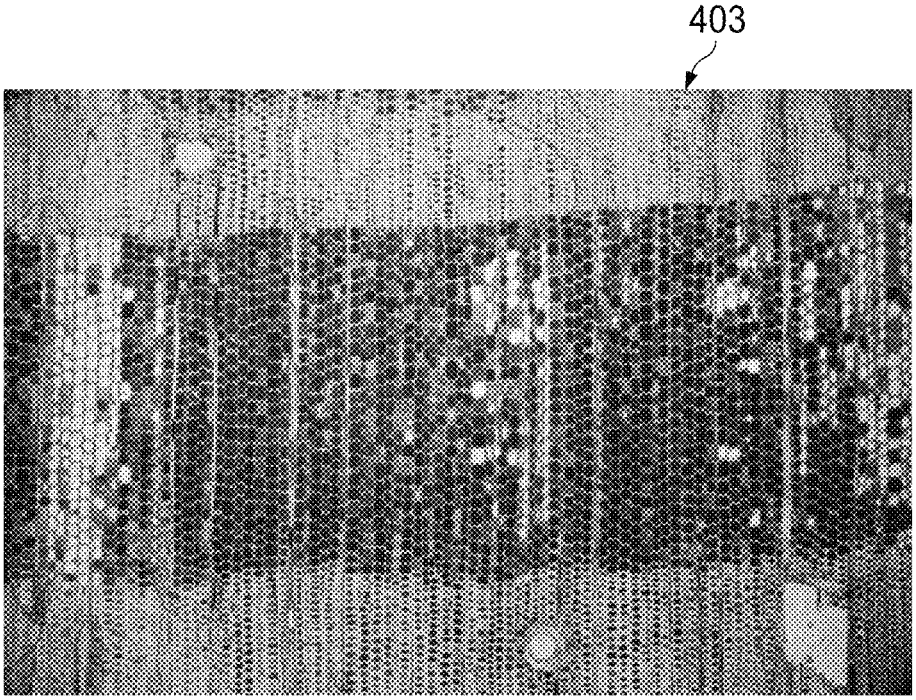

FIGS. 6A, 6B, and 6C show cross-sectional images of sample 402 from B1 of pine strips 1, 2, and 3, respectively, where the wood vessels are filled with a polymer solution that is not hardened. FIGS. 7A, 7B, and 7C show cross-sectional images of sample 403 from B1 of pine strips 1, 2, and 3, respectively, where the wood vessels are filled with a polymer solution that is not hardened.

Figure 8A:
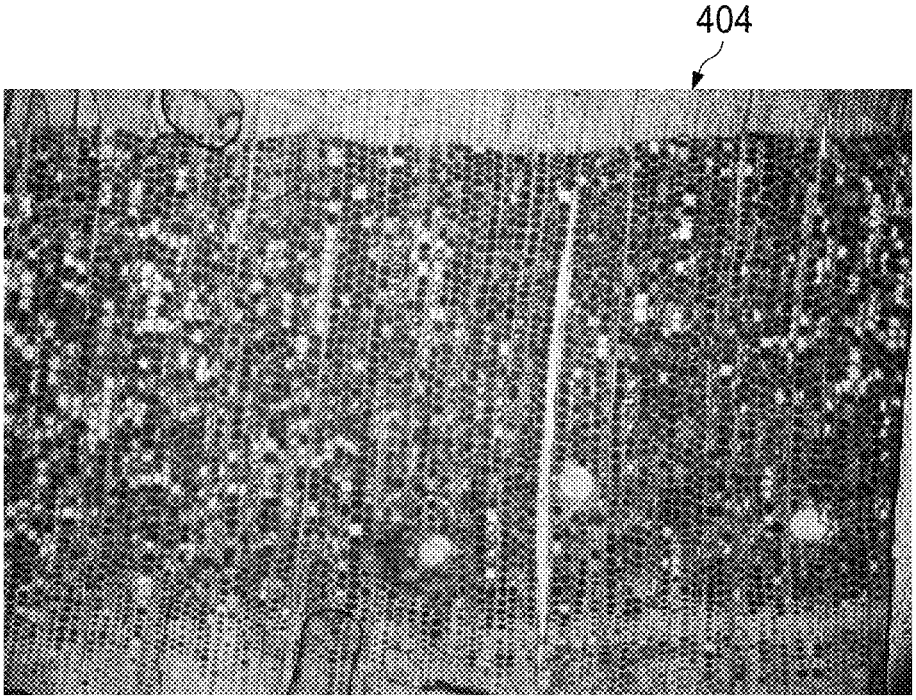
FIGS. 8A, 8B, and 8C are each a microscope image of a portion of a wood piece, according to a specific example embodiment of the disclosure.
Figure 8B:
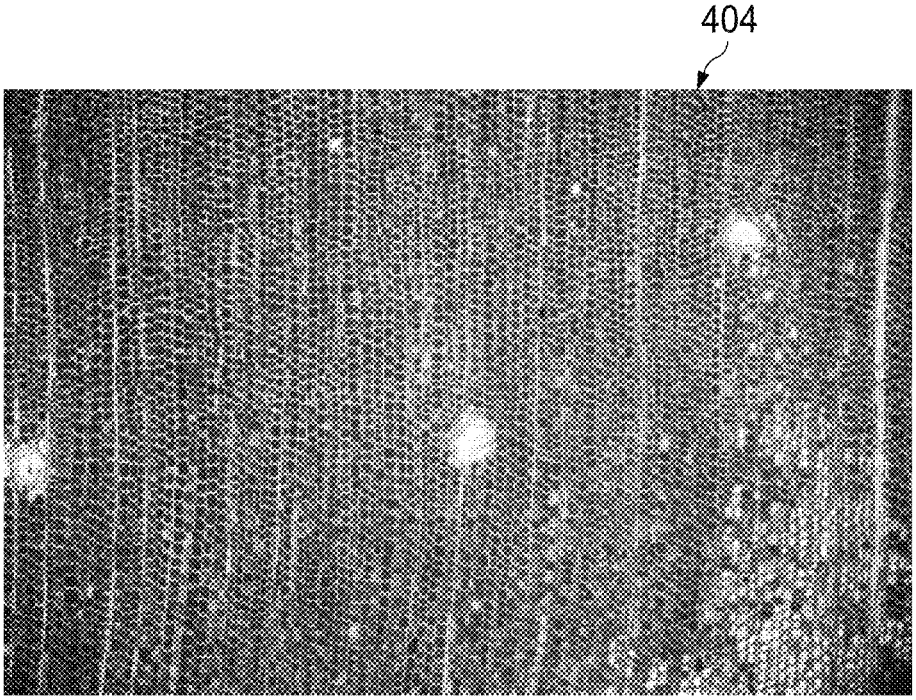
Figure 8C:
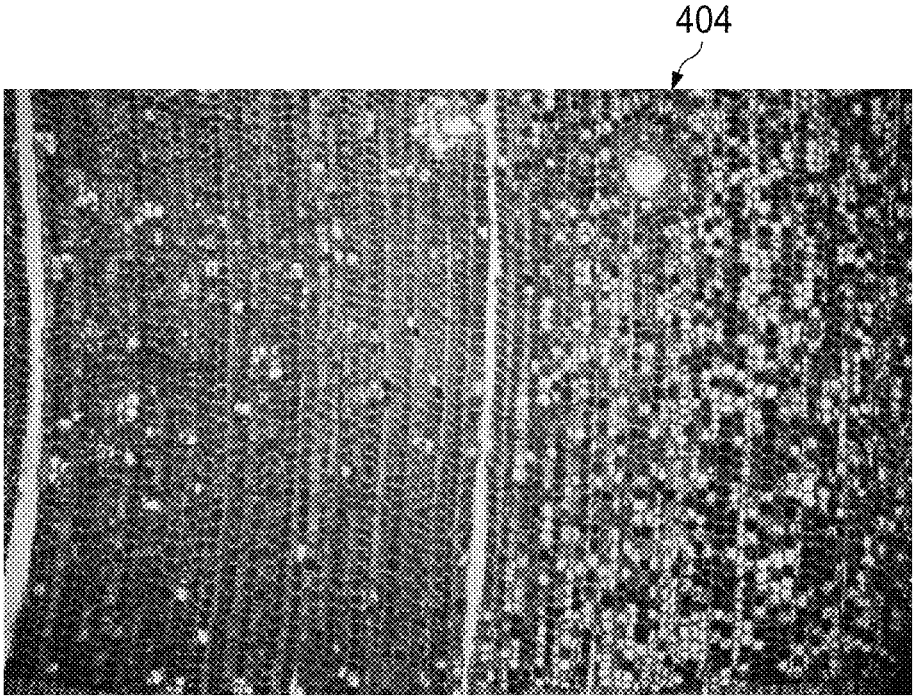
Figure 9A:
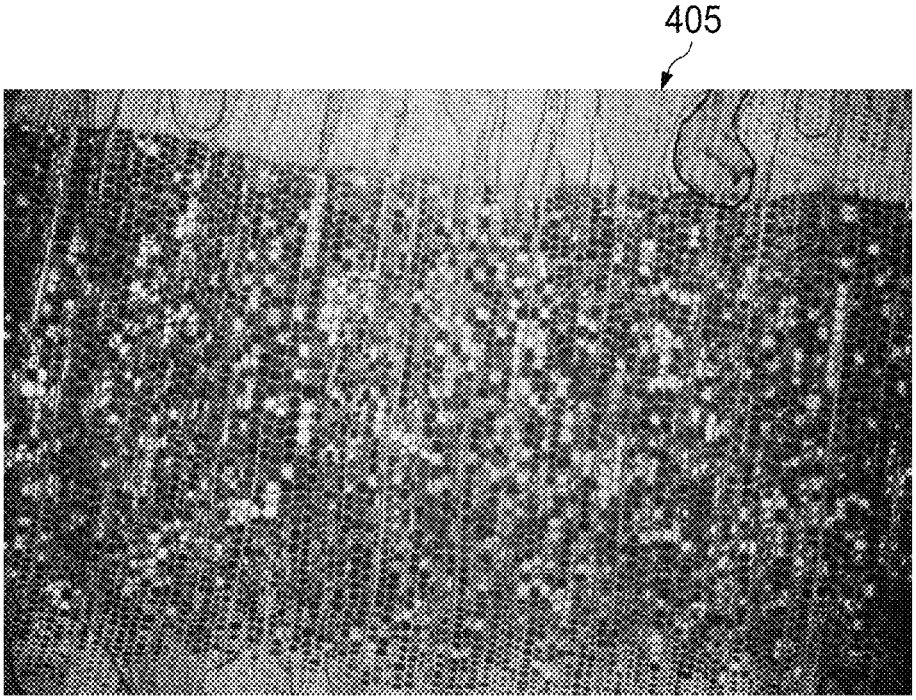
FIGS. 9A, 9B, and 9C are each a microscope image of a portion of a wood piece, according to a specific example embodiment of the disclosure.
Figure 9B:
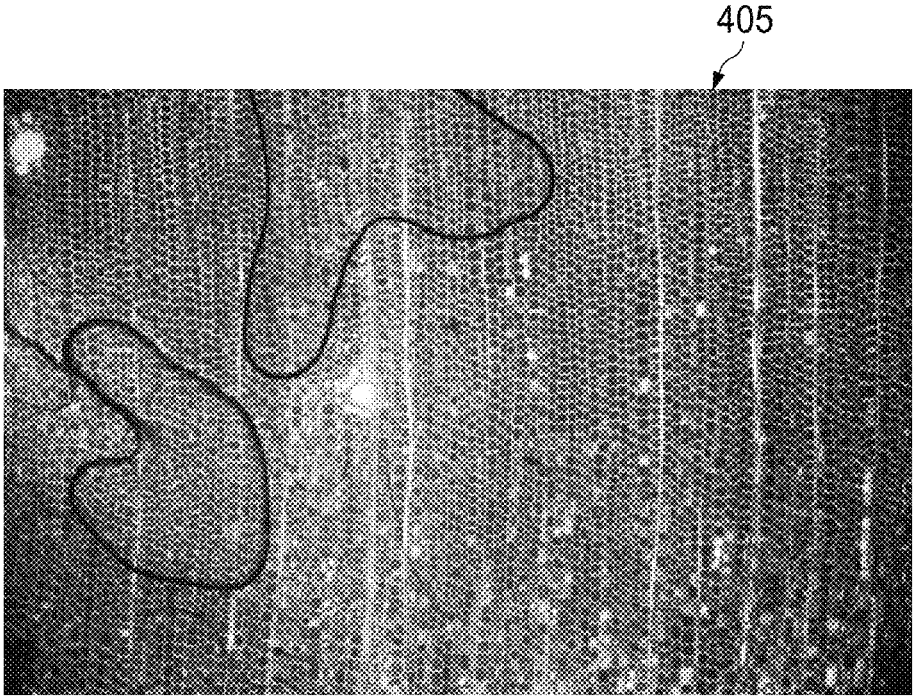
Figure 9C:
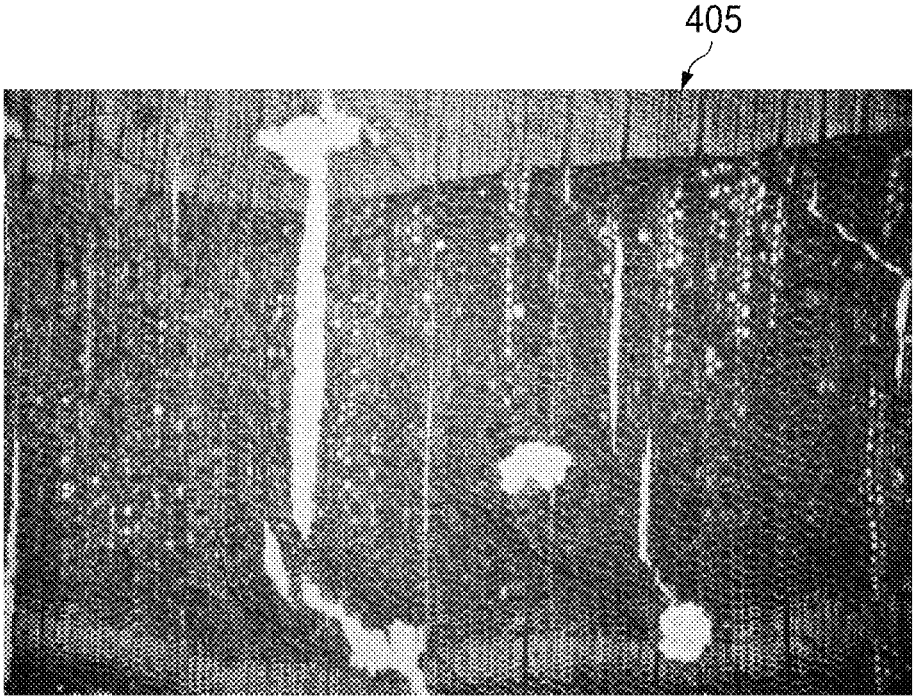

Wood pieces C1 and C2 were set by high-frequency drying of the wood pieces which hardened the polymer. During the set process, the temperature surrounding the wood pieces was gradually increased from ambient temperature to 110° C.±3° C. until it reached a set point of about 110° C.±3° C. The wood pieces were maintained at 110° C.±3° C. for about 30 minutes and then the kiln was gradually permitted to cool with the wood pieces remaining inside. The kiln temperature was gradually decreased over a period of 4 to 6 hours to a final temperature of about 30° C. After the pine wood pieces went through the final processing step of drying, thereby hardening the polymer, two samples of the pine wood were taken from wood piece C1 of each of the three pine strips. The locations of the samples are shown in FIG. 4, marked 404 and 405. The wood pieces of region C1 were cut into pieces of about 1 cm×1 cm×2 cm. A sample 404 was selected from the region that would have corresponded to about 1 cm from the boundary with wood piece A if the wood pieces were oriented based on their initial locations (see FIG. 4). Sample 405 was selected from the region that would have corresponded to about 20 cm from the boundary with wood piece A if the wood pieces were oriented based on their initial locations (see FIG. 4). A cross-section of the samples having a thickness of 20 μm to 25 μm was taken from each of the six sample (3 samples of 404 from pine strip 1,2, and 3 respectively and 3 samples of 405 from pine strip 1, 2, and 3 respectively). All six samples were microscopically analyzed. FIGS. 8A, 8B, and 8C show cross-sectional images of sample 404 from C1 of pine strips 1, 2, and 3, respectively, where the wood vessels are filled with a polymer solution that is hardened. FIGS. 9A, 9B, and 9C show cross-sectional images of sample 405 from C1 of pine strips 1, 2, and 3, respectively, where the wood vessels are filled with a polymer solution that is hardened.

The samples of wood pieces B1 and C1 have been analyzed with regard to the proportion of the wood vessels that contain polymer molecules. As shown in TABLE 5, the samples of wood piece B1 show that at least 84% of the wood vessels are filled with polymer solution. As shown in TABLE 6, the samples of wood piece C1 show that at least 80% of the wood vessels are filled with hardened polymer.

TABLE 5

5 Wood Piece B1: Proportion of wood vessels containing polymer molecules.

| Strip Number | FIG. No. | Sample # | Proportion |
|---|---|---|---|
| 1 | 6A | 402 | 95% |
| | 7A | 403 | 85% |
| 2 | 6B | 402 | 99% |
| | 7B | 403 | 99% |
| 3 | 6C | 402 | 84% |
| | 7C | 403 | 89% |

TABLE 6

Wood Piece C1: Proportion of wood vessels containing polymer molecules.

| Strip Number | FIG. No. | Location of sample | Proportion |
|---|---|---|---|
| 1 | 8A | 404 | 80% |
| | 9A | 405 | 95% |

TABLE 6-continued

Wood Piece C1: Proportion of wood vessels containing polymer molecules.

| Strip Number | FIG. No. | Location of sample | Proportion |
|---|---|---|---|
| 2 | 8B | 404 | 98% |
| | 9B | 405 | 98% |
| 3 | 8C | 404 | 85% |
| | 9C | 405 | 80% |

Samples C1 were tested by The Institute of Forest Industries of Vietnam for their physico-mechanical properties on the basis of a 12% moisture content. The technical properties are listed in 7.

TABLE 7

Physico-mechanical properties of processed pine wood strips.

| Property | Experiment standards | Result |
|---|---|---|
| Density (g/cm$^3$) | TCVN 8048-2:2009 | 1.09 |
| Longitudinal compressive strength (MPa) | TCVN 363-70 | 62 |
| Statical bending strength (MPa) | TCVN 8048-3:2009 | 91 |
| Formaldehyde content (mg/100 g) | TCVN 7756-12:2007 | 0.09 |

The processes described in Example 1 were repeated multiple time and a number of physic-mechanical properties of the resulting wood products were evaluated by the Institute of Forest Industries of Vietnam. Results are shown in Table 8.

TABLE 8

Physico-mechanical properties of processed pine wood

| Property | Result |
|---|---|
| Density (g/cm$^3$) | 1.11 ± 0.01 |
| Coefficient of contraction | 0.47 ± 0.02 |
| Longitudinal compressive strength (MPa) | 59 ± 1.4 |
| Statical bending strength (MPa) | 100.1 ± 3.2 |
| Formaldehyde content (mg/100 g) | 0.02 |
| Statical Hardness (%) | |
| Radial | 9371 ± 886 |
| Tangent | 12400 ± 513 |
| Volume | 11445 ± 770 |
| Contraction (%) | |
| Radial | 2.68 ± 0.01 |
| Tangent | 5.61 ± 0.02 |
| Volume | 8.69 ± 0.02 |
| Expansion (%) | |
| Radial | 2.51 ± 0.05 |
| Tangent | 5.59 ± 0.06 |
| Volume | 8.80 ± 0.12 |

The results indicate that wood treated by methods disclosed in the present disclosure has improved density and strength. The processed wood meets the standards for manufacturing furniture.

What is claimed is:

1. A method of processing a wood piece to generate a wood product, the method comprising:

(a) placing the wood piece into a reactor and generating a vacuum environment;

(b) inserting a fixed amount of a polymer solution into the reactor having the vacuum environment resulting in an increase in a chamber pressure;

(c) performing an iterative process where each cycle of the iterative process comprises a pressurizing period during which the chamber pressure is increased to an increased chamber pressure and a stabilizing period during which the chamber pressure is monitored to measure a chamber pressure decrease, if any, the iterative process comprising the following steps:

(i) activating a pressure element to increase the chamber pressure during the pressurizing period by a value less than or equal to a maximum pressure change to the increased chamber pressure for the cycle;

(ii) monitoring the chamber pressure during the stabilizing period to determine a magnitude of the chamber pressure decrease, if any, from the increased chamber pressure for the cycle;

(iii) if the decrease of chamber pressure during the stabilizing period for the cycle is more than a certain threshold range, repeat these steps (i) through (iii);

(d) when the decrease of chamber pressure during the stabilizing period is less than or equal to the certain threshold change, normalizing the reactor chamber to a normalized pressure; and (e) setting the wood piece to generate the wood product.

2. The method of claim 1, further comprising drying the wood piece to a specified moisture content before placing the wood piece into the reactor.

3. The method of claim 2, wherein the specified moisture content is less than about 12%.

4. The method of claim 2, further comprising decreasing a temperature surrounding the wood piece to a value below ambient temperature prior to exposing the wood piece to the vacuum environment.

5. The method of claim 4, wherein the temperature is decreased to a value of less than about 5° C.

6. The method of claim 1, wherein the polymer solution is selected from the group consisting of melamine polymer, urea-formaldehyde polymer, phenol-formaldehyde polymer, melamine formaldehyde polymer, and any combination thereof.

7. The method of claim 1, wherein the polymer solution comprises one or more additives selected from the group consisting of lignin, ash, industrial color, and any combination thereof.

8. The method of claim 1, wherein the polymer solution has a viscosity of less than about 300 cP.

9. The method of claim 1, further comprising:

after inserting a fixed amount of a polymer solution into the pressure chamber, but before performing the iterative process, exposing the wood piece to an ambient pressure for a dwell time.

10. The method of claim 9, wherein the dwell time is between 15 min and 30 min.

11. The method of claim 1, further comprising maintaining the wood piece at the normalized pressure for a period between about 12 h and 24 h.

12. The method of claim 1, wherein setting the wood piece comprises drying the wood piece in a vacuum drying kiln.

13. The method of claim 1, wherein the polymer solution has a polymer content of less than about 60% (w/w).

14. The method of claim 1, wherein the polymer solution has a pH value between about 8.5 and about 9.5.

15. The method of claim 1, wherein the wood piece comprises pine, and wherein the maximum pressure change is about 5 atm.

16. The method of claim 1, wherein the wood piece comprises ash, wherein the maximum pressure change for ash wood is about 7 atm.

* * * * *